US012385168B2

(12) United States Patent
Slezak et al.

(10) Patent No.: US 12,385,168 B2
(45) Date of Patent: Aug. 12, 2025

(54) DIGITAL CREEL SYSTEM

(71) Applicant: RJS CORPORATION, Akron, OH (US)

(72) Inventors: Frederick A. Slezak, Akron, OH (US); Charles Winafeld, Akron, OH (US); Brent C. Cronebach, Akron, OH (US); Chad Zivich, Akron, OH (US); Margaret Manning, Akron, OH (US); Clinton A. Hill, Akron, OH (US); Lee W. Miller, Akron, OH (US); Eric J. Whittaker, Akron, OH (US)

(73) Assignee: RJS CORPORATION, Akron, OH (US)

( * ) Notice: Subject to any disclaimer, the term of this patent is extended or adjusted under 35 U.S.C. 154(b) by 0 days.

(21) Appl. No.: 17/754,913

(22) PCT Filed: Oct. 19, 2020

(86) PCT No.: PCT/US2020/056331
§ 371 (c)(1),
(2) Date: Apr. 15, 2022

(87) PCT Pub. No.: WO2021/077085
PCT Pub. Date: Apr. 22, 2021

(65) Prior Publication Data

US 2024/0125014 A1 Apr. 18, 2024

Related U.S. Application Data

(60) Provisional application No. 62/916,375, filed on Oct. 17, 2019.

(51) Int. Cl.
*D02H 1/00* (2006.01)
*B65H 49/26* (2006.01)
(Continued)

(52) U.S. Cl.
CPC ..... *D02H 1/00* (2013.01); *B65H 49/26* (2013.01); *B65H 49/32* (2013.01); *B65H 59/04* (2013.01);
(Continued)

(58) Field of Classification Search
CPC ..... B65H 49/20; B65H 49/26; B65H 49/32; B65H 49/34; B65H 59/02; B65H 59/04;
(Continued)

(56) References Cited

U.S. PATENT DOCUMENTS 2,343,181 A * 2/1944 Heinz ..... B65H 59/04 242/413.4
3,687,394 A * 8/1972 Neumeister ..... B65H 63/00 242/131
(Continued)

FOREIGN PATENT DOCUMENTS

CN 1272490 C 8/2006
CN 108249220 A 7/2018
(Continued)

OTHER PUBLICATIONS

International Preliminary Report on Patentability in PCT/US2020/056331, dated Jan. 19, 2021, forms PCT/IB/373 and PCT/ISA/237, 10 pages.
(Continued)

*Primary Examiner* — Anna M Momper
*Assistant Examiner* — Raveen J Dias
(74) *Attorney, Agent, or Firm* — Vorys, Sater, Seymour and Pease LLP; Rex W. Miller, II

(57) ABSTRACT

A creel system includes a plurality of tension controller apparatuses that hold spools of wire. The tension controller apparatuses apply tension to the wire and may be manipulated to fine-tune or control the tension applied to the wire. The creel system may further include a plurality of sensors
(Continued)

that measure operation of the creel system as well as the condition of the wire. In such embodiments, the creel system may include a user-interface that provides data to the operator in real time and with which the operator may interact to control operation of the creel system.

11 Claims, 30 Drawing Sheets

(51) Int. Cl.

| | |
|---|---|
| ***B65H 49/32*** | (2006.01) |
| ***B65H 59/04*** | (2006.01) |
| ***B65H 59/26*** | (2006.01) |
| ***B65H 59/38*** | (2006.01) |
| ***B65H 63/024*** | (2006.01) |
| ***B65H 63/04*** | (2006.01) |
| ***D02H 13/24*** | (2006.01) |

(52) U.S. Cl.
CPC ..... *B65H 59/26* (2013.01); *B65H 59/381* (2013.01); *B65H 63/024* (2013.01); *B65H 63/04* (2013.01); *D02H 13/24* (2013.01)

(58) Field of Classification Search
CPC .... B65H 59/043; B65H 59/38; B65H 59/381; B65H 59/382; B65H 59/40; B65H 59/12; B65H 59/24; B65H 59/26; B65H 59/30; B65H 59/34; B65H 59/36; B65H 63/02; B65H 63/024; B65H 63/04; D02H 1/00; D02H 13/22; D02H 13/24
See application file for complete search history.

(56) References Cited

U.S. PATENT DOCUMENTS

| | | | | | |
|---|---|---|---|---|---|
| 3,899,143 | A * | 8/1975 | Slezak | B65H 59/04 | 242/422.4 |
| 4,344,582 | A | 8/1982 | Rapp et al. | | |
| 5,023,976 | A | 6/1991 | Meyer et al. | | |
| 5,052,088 | A * | 10/1991 | Hagewood | D02H 13/02 | 28/245 |
| 5,588,194 | A * | 12/1996 | Ulbrich | D02H 13/02 | 28/190 |
| 5,810,271 | A * | 9/1998 | Hamilton | B65H 57/14 | 242/615.3 |
| 5,823,458 | A * | 10/1998 | Huang | B65H 59/04 | 242/396.6 |
| 5,957,402 | A * | 9/1999 | McEathron | B65H 54/026 | 242/413.3 |
| 6,010,089 | A | 1/2000 | Winafeld et al. | | |
| 6,095,449 | A * | 8/2000 | Gallo | G01L 5/107 | 242/419.1 |
| 6,098,910 | A * | 8/2000 | Slezak | B65H 59/046 | 188/74 |
| 6,375,111 | B1 * | 4/2002 | Mycielski | B65H 57/18 | 242/417.3 |
| 6,435,445 | B1 * | 8/2002 | Slezak | B65H 59/046 | 242/422.8 |
| 6,501,040 | B2 | 12/2002 | Hall et al. | | |
| 6,691,945 | B2 * | 2/2004 | Slezak | B65H 59/04 | 242/420 |
| 6,820,833 | B1 * | 11/2004 | Carlsson | B65H 59/04 | 242/420.5 |
| 7,770,271 | B2 * | 8/2010 | Kleiner | D02H 13/24 | 28/190 |
| 8,500,056 | B1 * | 8/2013 | Slezak | B65H 59/04 | 242/147 M |
| 9,278,493 | B2 * | 3/2016 | Aumueller | B65H 59/40 | |
| 2001/0045486 | A1 * | 11/2001 | Zeller | D02H 13/24 | 242/419.1 |
| 2003/0122024 | A1 * | 7/2003 | Slezak | B65H 59/04 | 242/421.7 |
| 2004/0050995 | A1 | 3/2004 | Ingram | | |
| 2013/0098525 | A1 * | 4/2013 | Aumueller | B65H 57/16 | 156/64 |
| 2013/0186994 | A1 * | 7/2013 | Slezak | B65H 59/04 | 242/421 |
| 2013/0270382 | A1 * | 10/2013 | Slezak | B65H 59/04 | 242/421 |
| 2014/0008481 | A1 * | 1/2014 | Slezak | B65H 59/04 | 242/421 |
| 2015/0048199 | A1 | 2/2015 | Slezak | | |
| 2017/0101286 | A1 | 4/2017 | Brockman et al. | | |
| 2017/0283210 | A1 * | 10/2017 | Piotrowski | B65H 59/24 | |
| 2024/0117535 | A1 * | 4/2024 | Sasaki | B65H 49/328 | |

FOREIGN PATENT DOCUMENTS

| | | | | |
|---|---|---|---|---|
| EP | 0319477 | B1 | 6/1992 | |
| EP | 1162295 | B1 | 10/2009 | |
| JP | 5112199 | B2 | 1/2013 | |
| KR | 101842437 | B1 * | 3/2018 | B65H 59/04 |
| KR | 101909499 | B1 * | 10/2018 | D02H 13/24 |

OTHER PUBLICATIONS

Supplementary Partial European Search Report issued in EP 20 87 7680 on Sep. 9, 2023, 11 pages.

* cited by examiner

FG. 1C
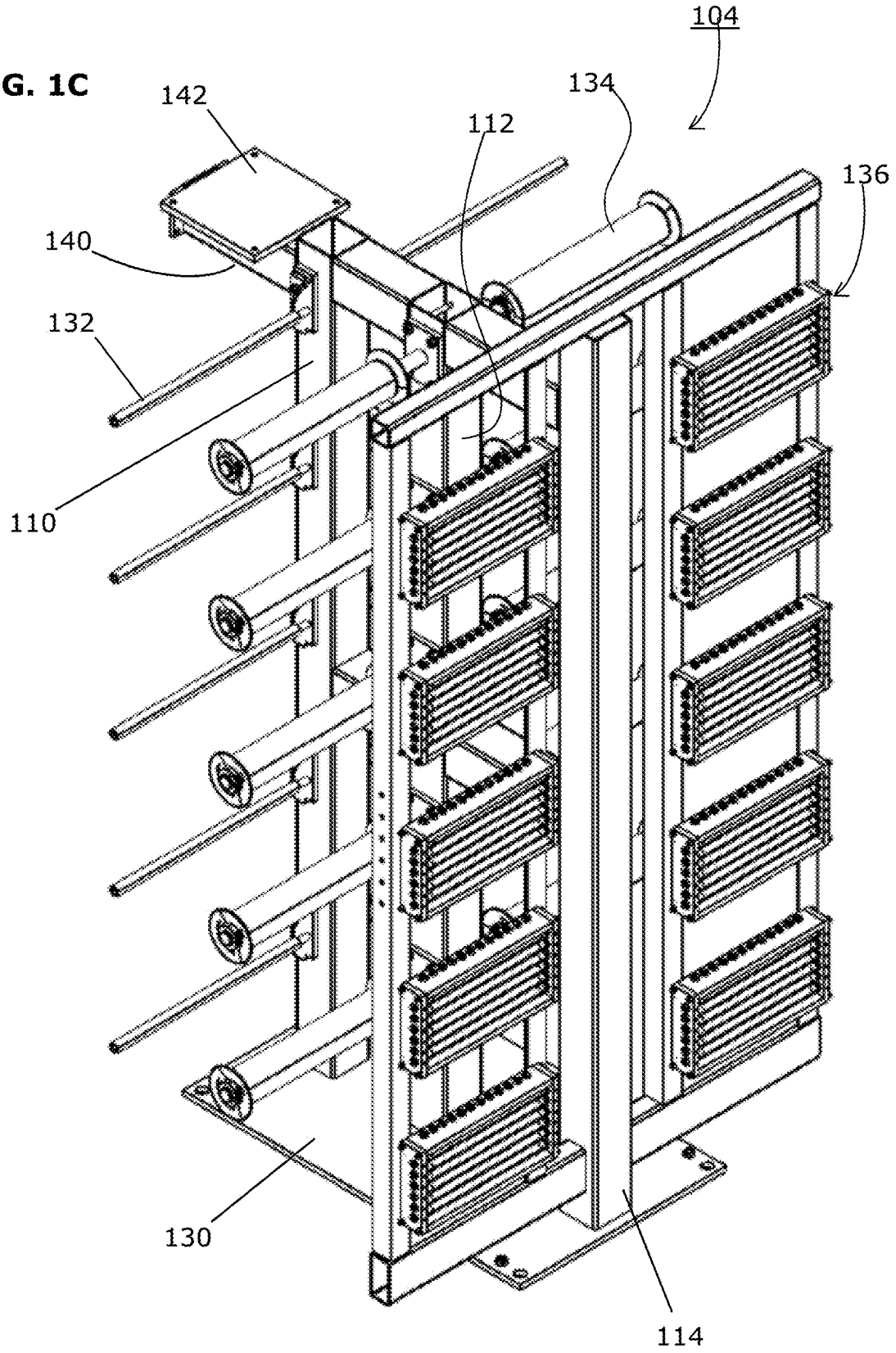

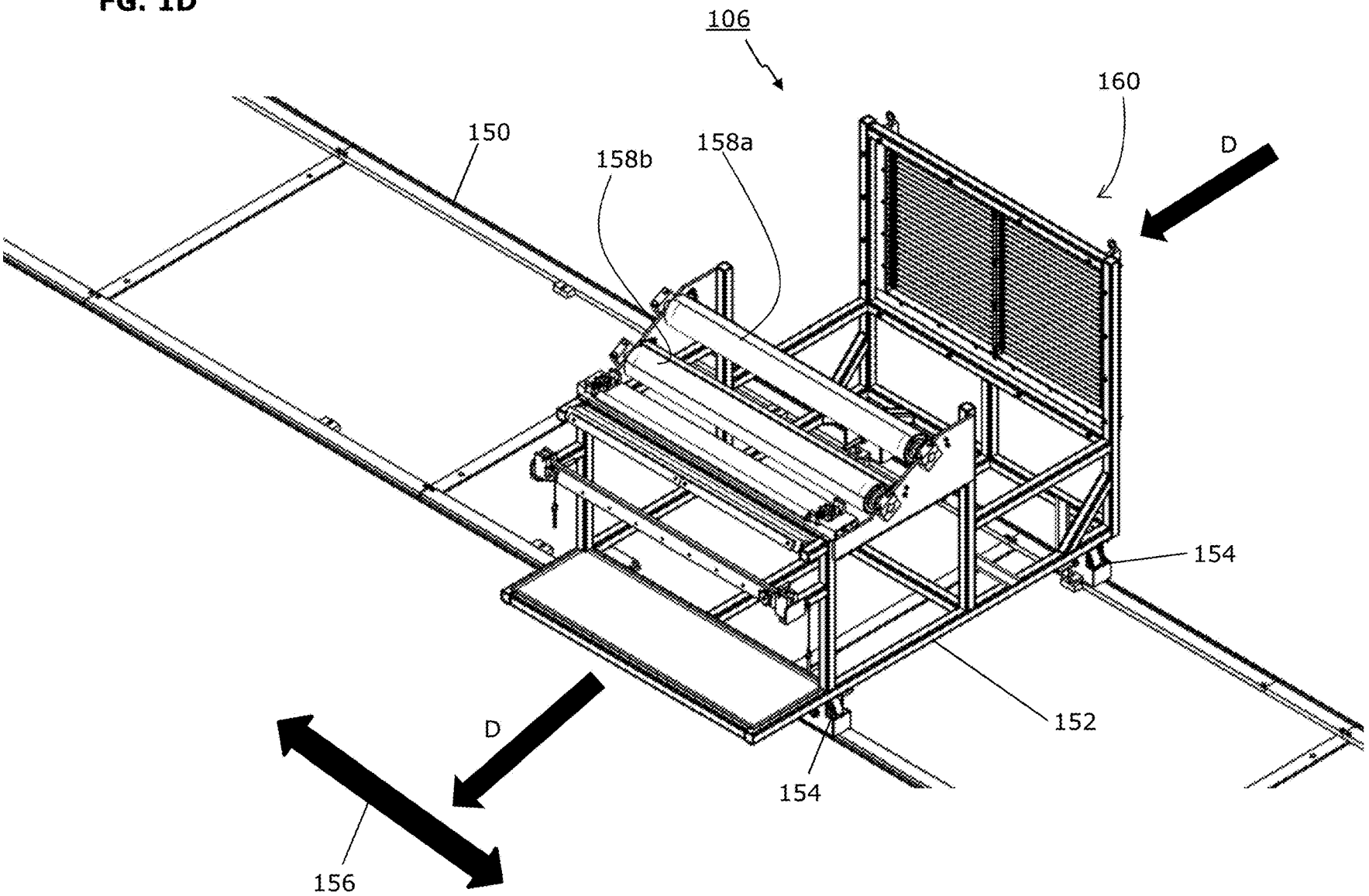
FG. 1D

FG. 2D
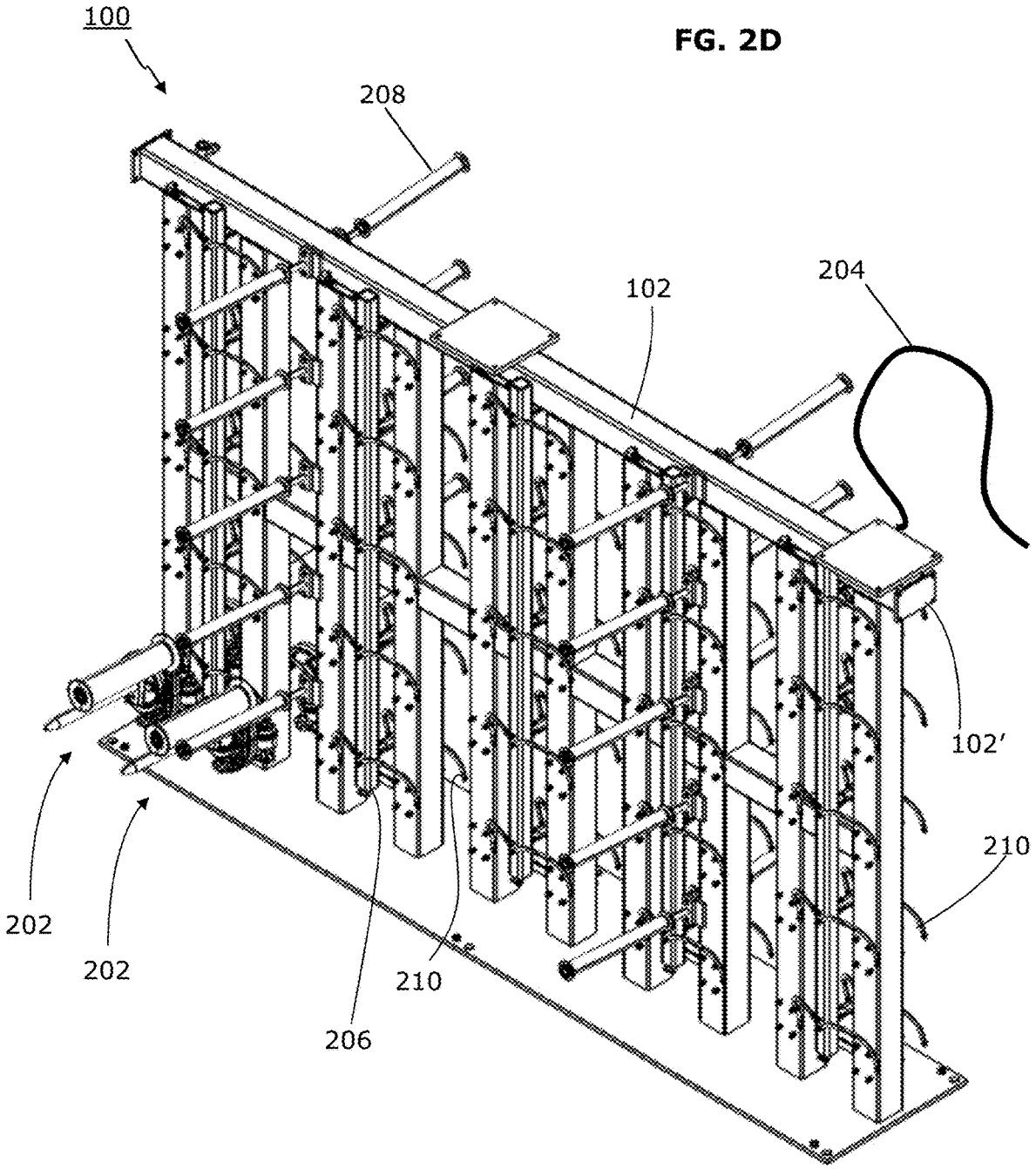

FIG. 8D
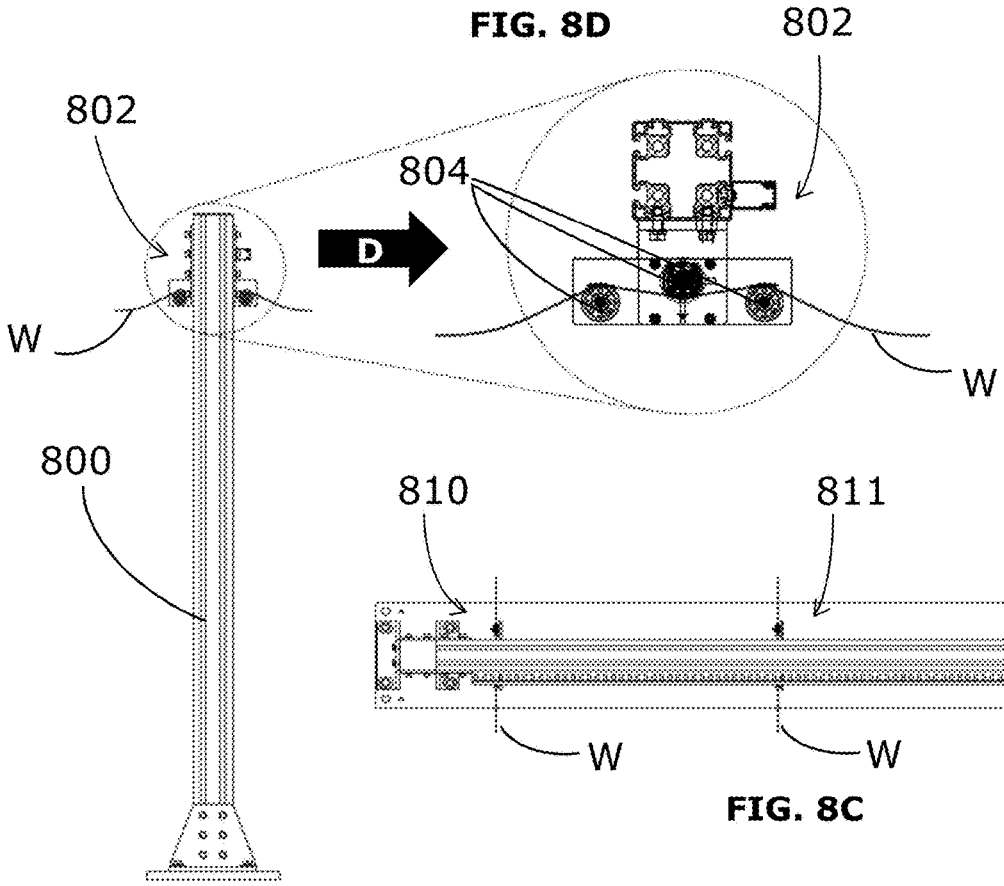
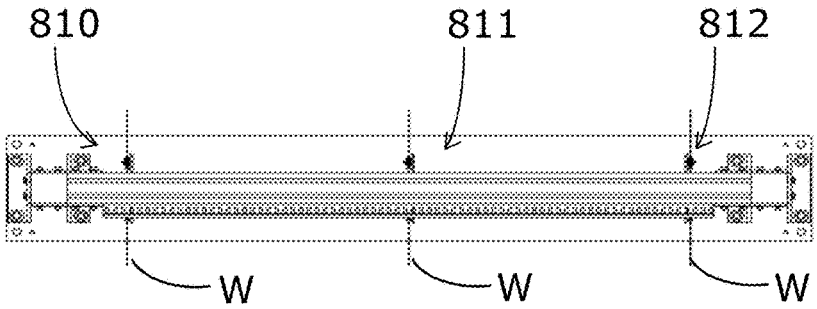
FIG. 8C
FIG. 8A

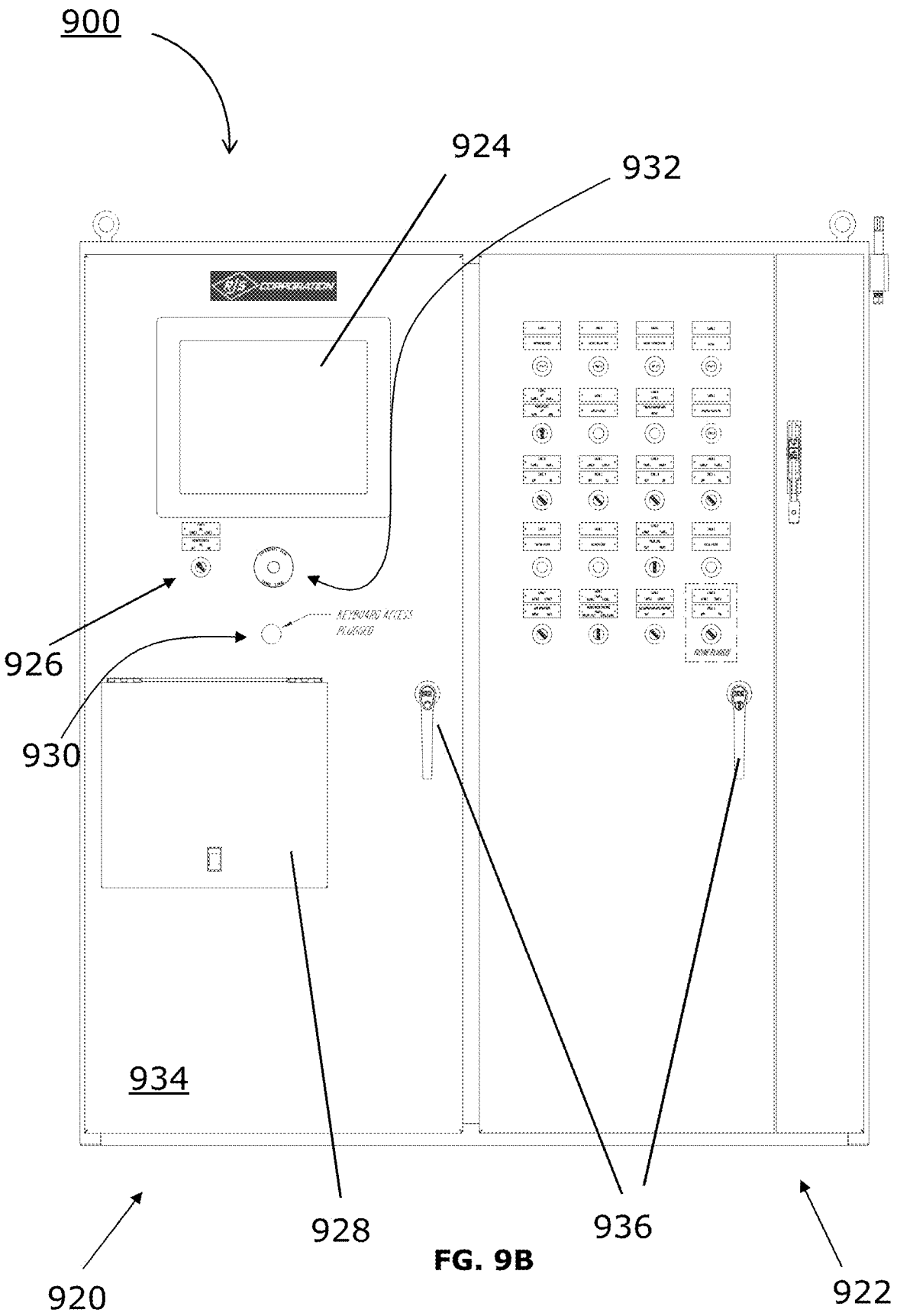
FG. 9B

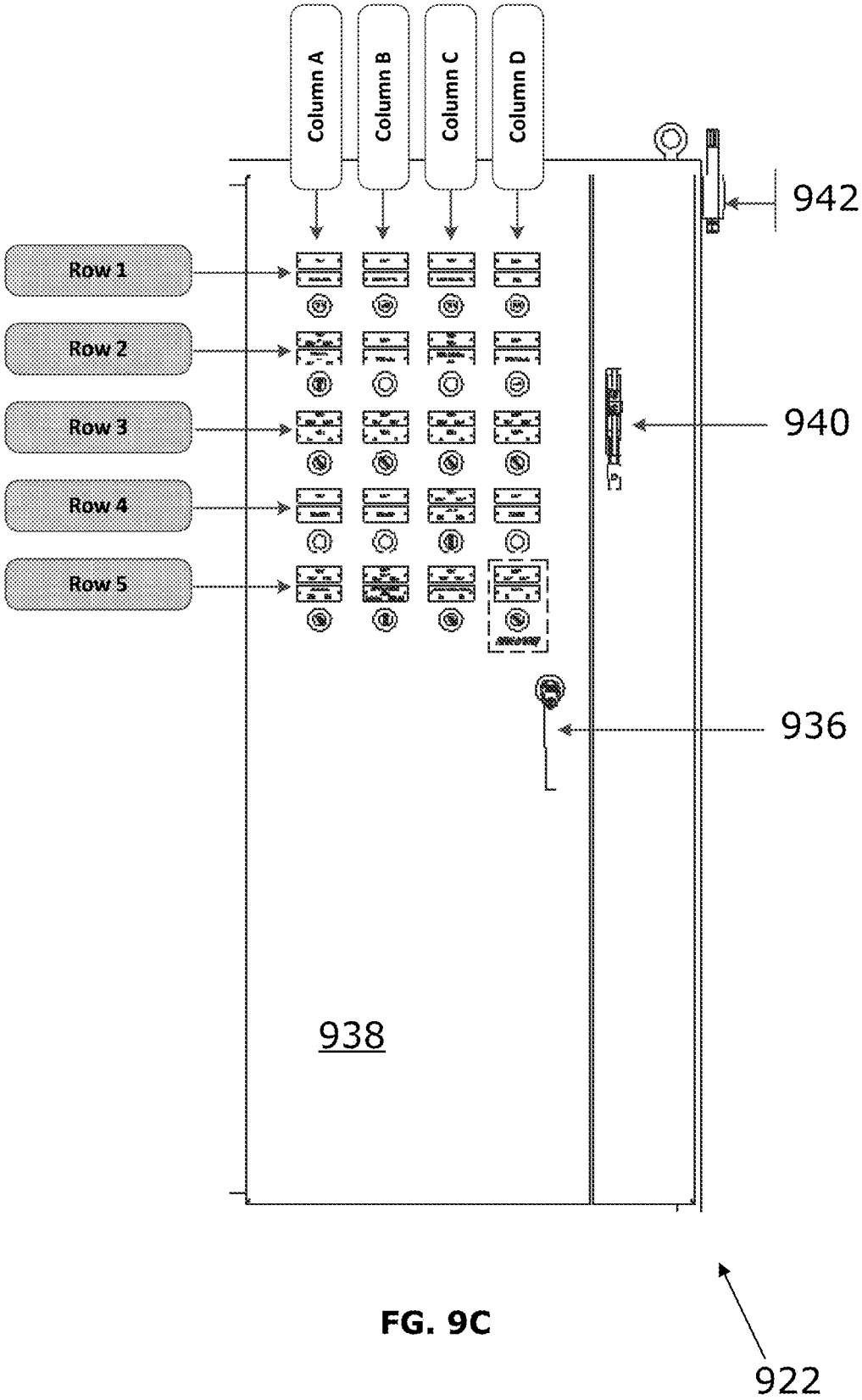
FG. 9C

1002

1004

1006

1008a

1008b

1008c

1008d

1016

1018

1018

1020

1020

1022

| ERROR MESSAGE TEXT |
| --- |
| MAIN AIR SUPPLY NOT PRESENT |
| COLLISION AVOIDANCE SYTEM OVERRIDE ACTIVE |
| INVALID CREEL COMBINATION/SELECTION |
| BROKEN OR LOOSE WIRE CREEL # L# |
| BROKEN OR LOOSE WIRE CREEL # R# |
| VFD (VARIABLE FREQUENCY DRIVE) FAULT VFD # |
| ACTIVE CREEL SAFETY ROPE TRIP CREEL # |
| COLLISION AVOIDANCE CREEL # LEFT SIDE |
| COLLISION AVOIDANCE CREEL # RIGHT SIDE |
| MAX TRAVEL RIGHT CREEL 1 |
| MAX TRAVEL LEFT CREEL 4 |

| KEY |
| --- |
| # = **CREEL** ROW NUMBER RIGHT TO LEFT (1 - 4) |
| L# = LEFT **WIRE** ROW NUMBER (1 - 5, TOP TO BOTTOM) |
| R# = RIGHT **WIRE** ROW NUMBER (1 - 5, TOP TO BOTTOM) |

FIG. 10L

1024

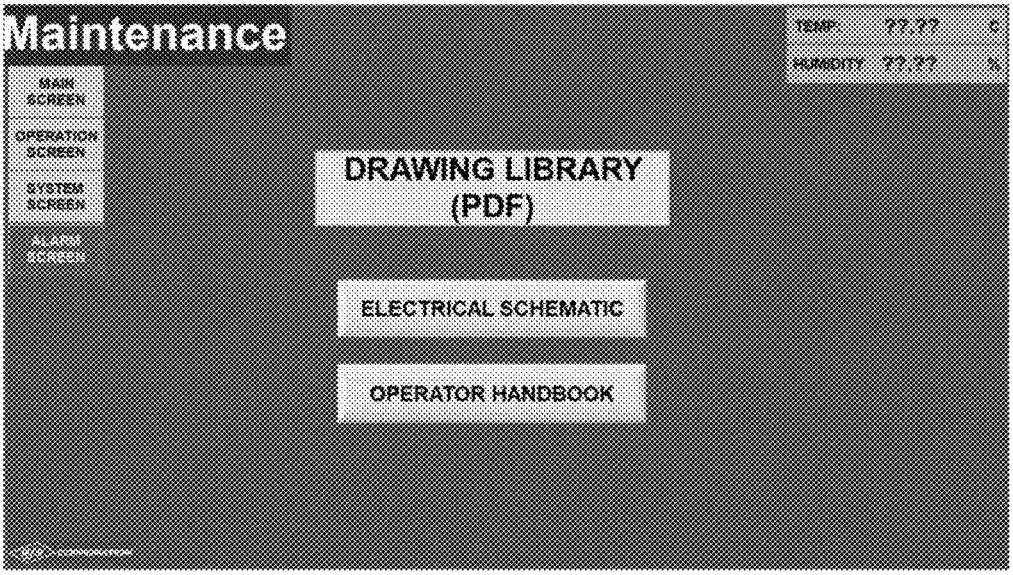

FIG. 10M

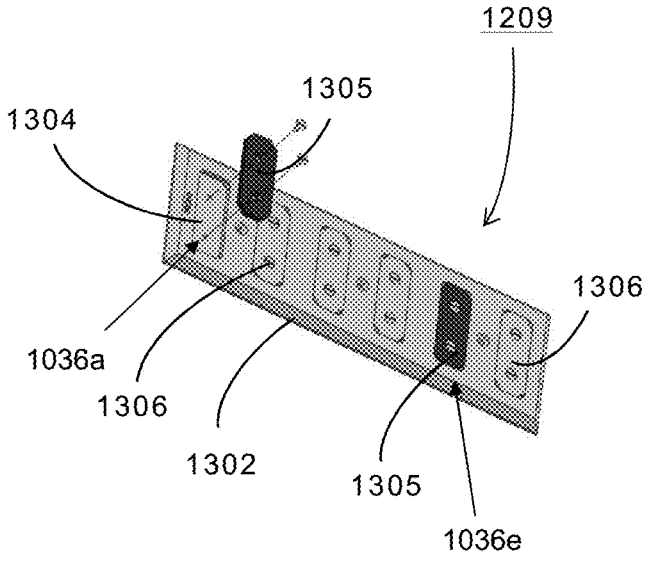
FG. 13A
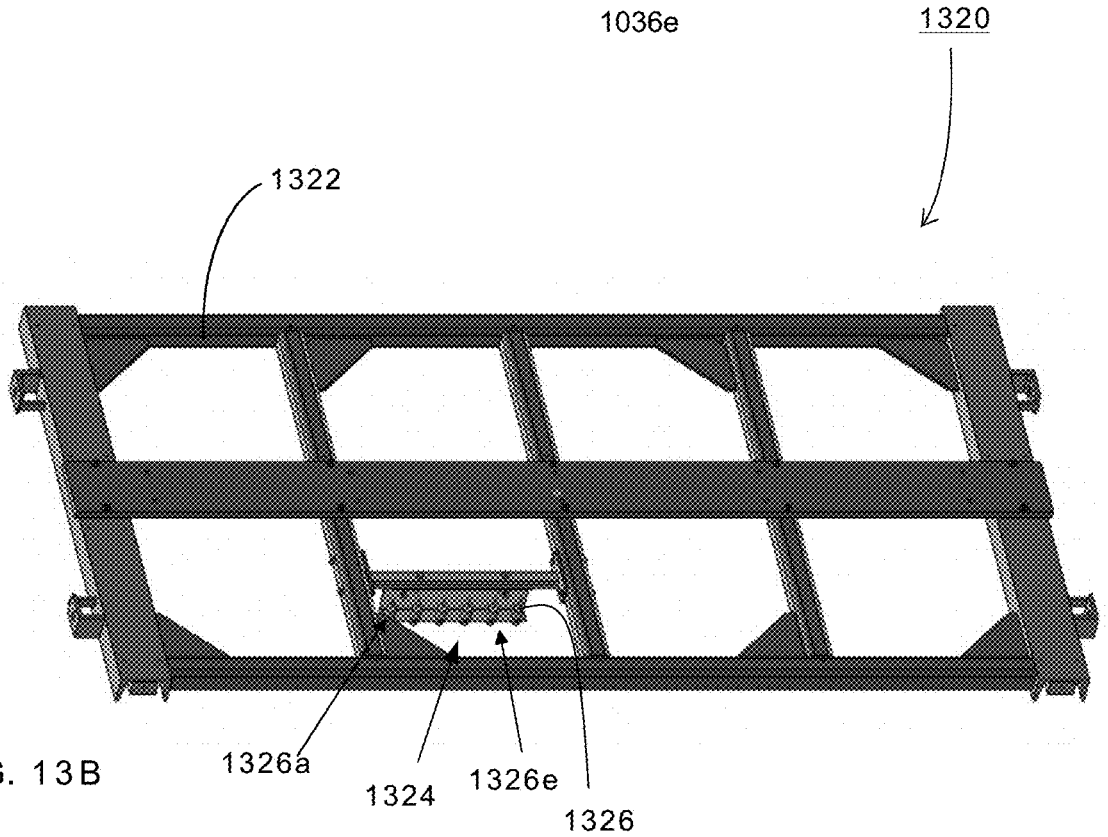
FG. 13B

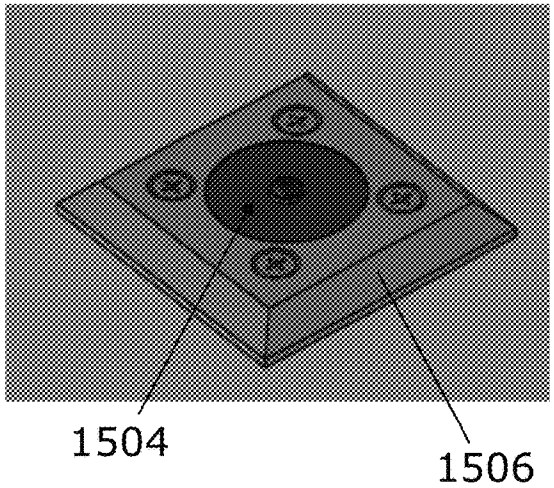
FG. 15C
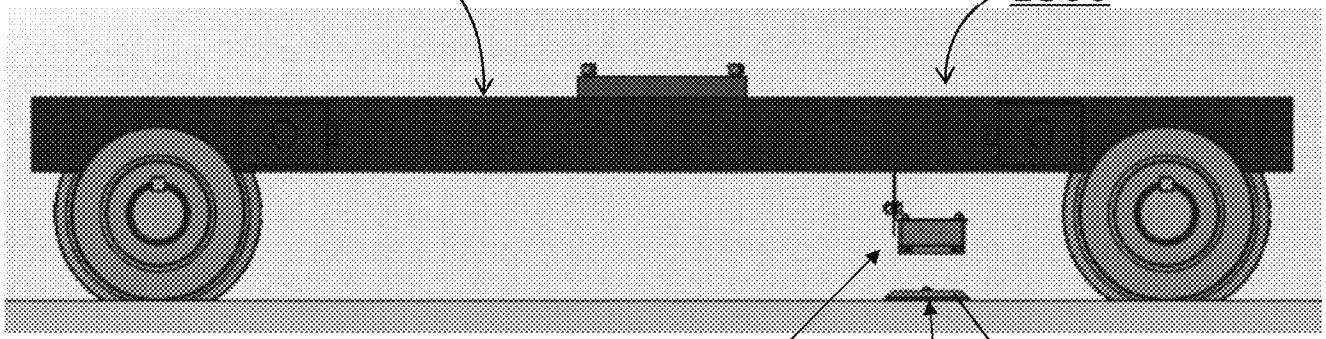
FG. 15B
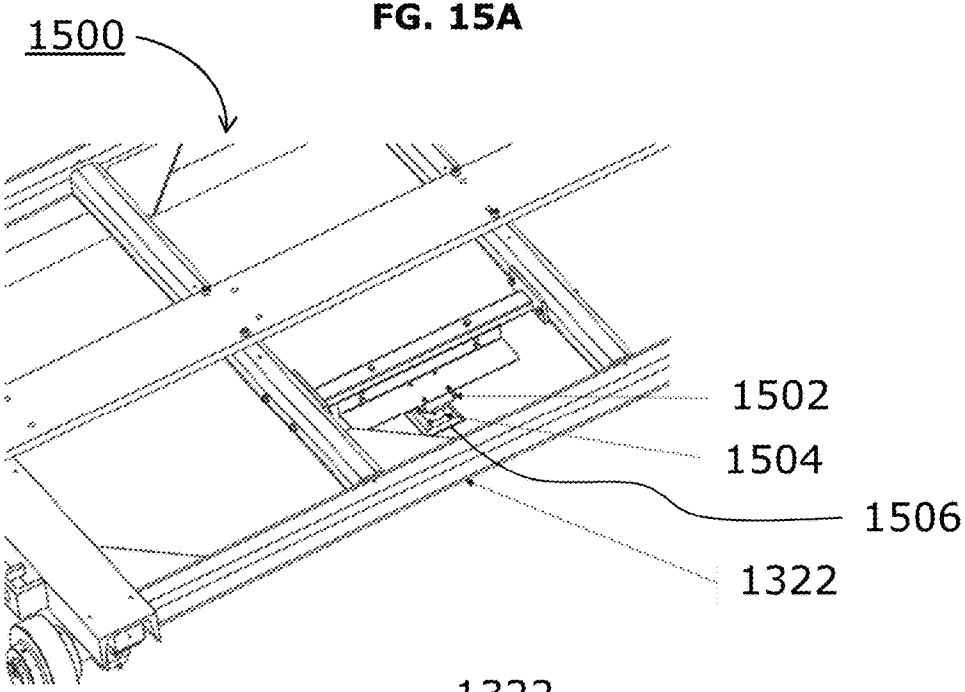
FG. 15A

DIGITAL CREEL SYSTEM

CROSS-REFERENCE TO RELATED APPLICATIONS

This application claims priority to and the benefit of pending International Patent Application PCT/US2020/056331, International File Date Oct. 19, 2020, which claims priority to U.S. Provisional Application No. 62/916,375, filed Oct. 17, 2019, which are incorporated by reference herein in their entirety.

BACKGROUND

Filamentary materials are commonly utilized as reinforcements for plastic or elastomeric compounds or may themselves be fabricated into integral arrangements as utilized in the textile, hose, and tire industries. These filamentary materials, often referred to as wires, are stored on (wrapped around) spools. In addition, these wires may include, without limitation, fibers in single and multiple strands, flat bands, or tubing produced in long lengths and wound on spools. The various wires may be either natural or synthetic fibers, glass or metal.

Creel systems are utilized to pull the wires from its spools and manipulate them into final form. Creel systems include a plurality of tension controller systems that each have a spindle that permit the spools to rotate as the wire is withdrawn therefrom. These tension controller systems have control arms and rollers that are utilized to provide tension to the wire and may be adjusted via compressed air. Creel systems may further comprise a front organizing stand into which wires are fed from the spools. Front organizing stands often include sub-systems, including a broken/loose wire detector sensor, direction change roller, and a front roller or eyelet board.

Conventional creel systems, however, are not able to measure and automatically adjust wire tension. Rather, conventional creel systems will sound an alarm if a wire is broken/loose wire contacts the conductive sensor rod on the front organizing stand and, if enough broken/loose wires are detected, production will be shut down and the suspect wires addressed. Moreover, conventional creel systems provide little feedback or operational feedback to the operator in real time.

In view of the shortcomings of the conventional creel systems, there is a need for a creel system that measures operating characteristics and displays the same to a user in real time so that the operator may take corrective action, and there is a need for a creel system that automatically controls and optimizes wire tension based on those measured operating characteristics.

SUMMARY

Embodiments herein are directed towards a creel system. The creel system may comprise a frame having a plurality of tension controller apparatuses for paying out a wire under tension, each of the tension controller apparatuses having a brake shoe that is engageable with a spindle and a control arm that that is rotatable towards the spindle to move the brake shoe away from the spindle and rotatable away from the spindle to move the brake shoe towards the spindle, an air pressure control system operatively connected to each of the tension controller apparatuses and actuatable to move the brake shoe towards the spindle, the tension control apparatus in communication with at least one apparatus sensor disposed on at least one of the control arms, and a central control system in communication with the air pressure control system, wherein the central control system ascertains a wire tension based on data from the apparatus sensor and the air pressure control system, and wherein the central control system is configured to actuate the air pressure control system in response to the wire tension. In a further embodiment, the creel system further comprises a loose wire detection system in communication with the central control system, the loose wire detection system comprising a wire tree positioned downstream from the frame and including a plurality of vertically spaced sensor bars configured to generate a loose wire detection signal upon contact between a wire and at least one sensor bar. In a further embodiment, the creel system further comprises a tension monitoring system in communication with the central control system, the tension monitoring system comprising a tension monitoring stand positioned downstream from the frame, the tension monitoring stand including at least one tension sensor that receives a wire from the frame, wherein the at least one tension sensor measures the tension of the received wire and generates a tension output signal that is sent to the central control system, wherein the central control system changes the air pressure of the air pressure control system based on the tension output signal. In another further embodiment, the tension monitoring stand comprises a left tension sensor, a center tension sensor, and a right tension sensor, each configured to receive a wire from a left portion of a plane of wires, a wire from a central portion of the plane of wires, and a wire from a right portion of the plane of wires. In a further embodiment, the creel system further comprises a plurality of platforms, wherein a frame having a plurality of tension controller apparatuses for paying out a wire under tension is mounted to each platform, each platform includes a set of wheels that are driven by a motor, the motor of each platform is in communication with the central control system which directs the motor to drive the associated platform to a target position. In another further embodiment, each platform includes a proximity sensor configured to generate a position signal in response to reading at least one feature plate located at a predetermined position on the creel room floor. In another further embodiment, the feature plate comprises a plate body having a plurality of pockets, each pocket is configured to receive one of a steel and nylon pad, an order of steel and nylon pads creating a unique code read by the proximity sensor relating to the position of the platform within the creel room. In another further embodiment, each platform includes at least one photo eye sensor configured to measure a distance between adjacent platforms, wherein the central control system generates a stop motion signal based on a predetermined threshold distance measured by the at least one photo eye sensor. In a further embodiment, the creel system further comprises at least one mechanical travel limit switch in communication with the central control system configured to prevent over-travel of a platform beyond a predetermined location. In a further embodiment, the creel system further comprises at least one pull switch comprising a rope mounted at a front end of a creel row, the pull switch generates a stop signal when the rope is pulled, the stop signal readable by the central control system to cease operation of the creel system. In another further embodiment, the central control system is configured to shut down the creel system based on a stop signal generated from a creel row based and determined position of the creel row in the creel room. In a further embodiment, the creel system further comprises a data storage in communication with the central control system, the data storage configured to storage a log file.

Embodiments herein are directed towards a method of operating a creel system, comprising: with a APC module, controlling the tension of at least one wire by directing an air pressure to at least one tension control apparatus having a brake shoe that is engageable with a spindle and a control arm that that is rotatable towards the spindle to move the brake shoe away from the spindle and rotatable away from the spindle to move the brake shoe towards the spindle; with LWD module, receiving sensor bar data from a plurality of sensor bars disposed on a wire tree a and determining a location on the wire tree where at least one wire contracts a sensor bar of the plurality of sensor bars; and with a Position module, tracking a position of a creel row with respect to a creel room based on location data received from at least one proximity sensor or other sensing technology device associated with each creel row and controlling a motor associated with each creel row to move a creel row to a target position. In a further embodiment, the method further comprises positioning a plurality of feature plates, each plate comprising a plate body having a plurality of pockets, each pocket is configured to receive one of a steel and nylon pad, wherein an order of steel and nylon pads creates a unique code readable by the proximity sensor and used by the position module to determine a location of the creel row. In a further embodiment, the method further comprises with an environment module, receiving environment data from at least one environment sensor and controlling the operation of the creel system based on data received by the at least one environment sensor. In a further embodiment, the method further comprises with a TMS module, receiving wire tension data from at least one tension sensor located between a creel row and a calender and/or; adjusting the air pressure delivered to at least one tension control apparatus based on a measured tension. In a further embodiment, the method further comprises with at least one mechanical travel limit switch in communication with the central control system, generate a limit switch signal and stop the motion of an associated creel row based on the generated limit switch signal. In a further embodiment, the method further comprises with a CAS module, receiving collision data from at least one eye sensor associated with each creel row and determining a distance between a creel row in motion and adjacent creel row, and controlling the motion of a moving creel row based on the determined distance between the creel row in motion and adjacent creel row. In a further embodiment, the method further comprises with at least one pull switch comprising a rope mounted at a front end of a creel row, generating a stop signal when the rope is pulled, and shutting down the operation of the creel system based on the pull switch signal. In another further embodiment, shutting down the creel system is based on both the stop signal generated from a creel row based on a determined position of the associated creel row in the creel room.

BRIEF DESCRIPTION OF THE DRAWINGS

The following figures are included to illustrate certain aspects of the present disclosure and should not be viewed as exclusive embodiments. The subject matter disclosed is capable of considerable modifications, alterations, combinations, and equivalents in form and function, without departing from the scope of this disclosure.

FIGS. 1C-1D are isometric perspective views of example creel system components.

FIGS. 2A-2D are perspective views of the creel system of FIG. 1A.

FIGS. 8A-8D are front, top, side, and cross-sectional views of a tension monitoring stand in accordance with the present disclosure.

FIG. 9C illustrates a close up of a side of the user interface of FIG. 9B.

FIGS. 9A and 9B illustrate various exemplary user interfaces.

FIG. 13A is an exemplary floor plate in accordance with the present disclosure, and FIG. 13B is an exemplary unit for detecting floor plates in accordance with the present disclosure.

FIGS. 15A-15C illustrate an alternate system for sensing or tracking position of the shifting creel rows, in accordance with the present disclosure.

DETAILED DESCRIPTION

Figure 1A:
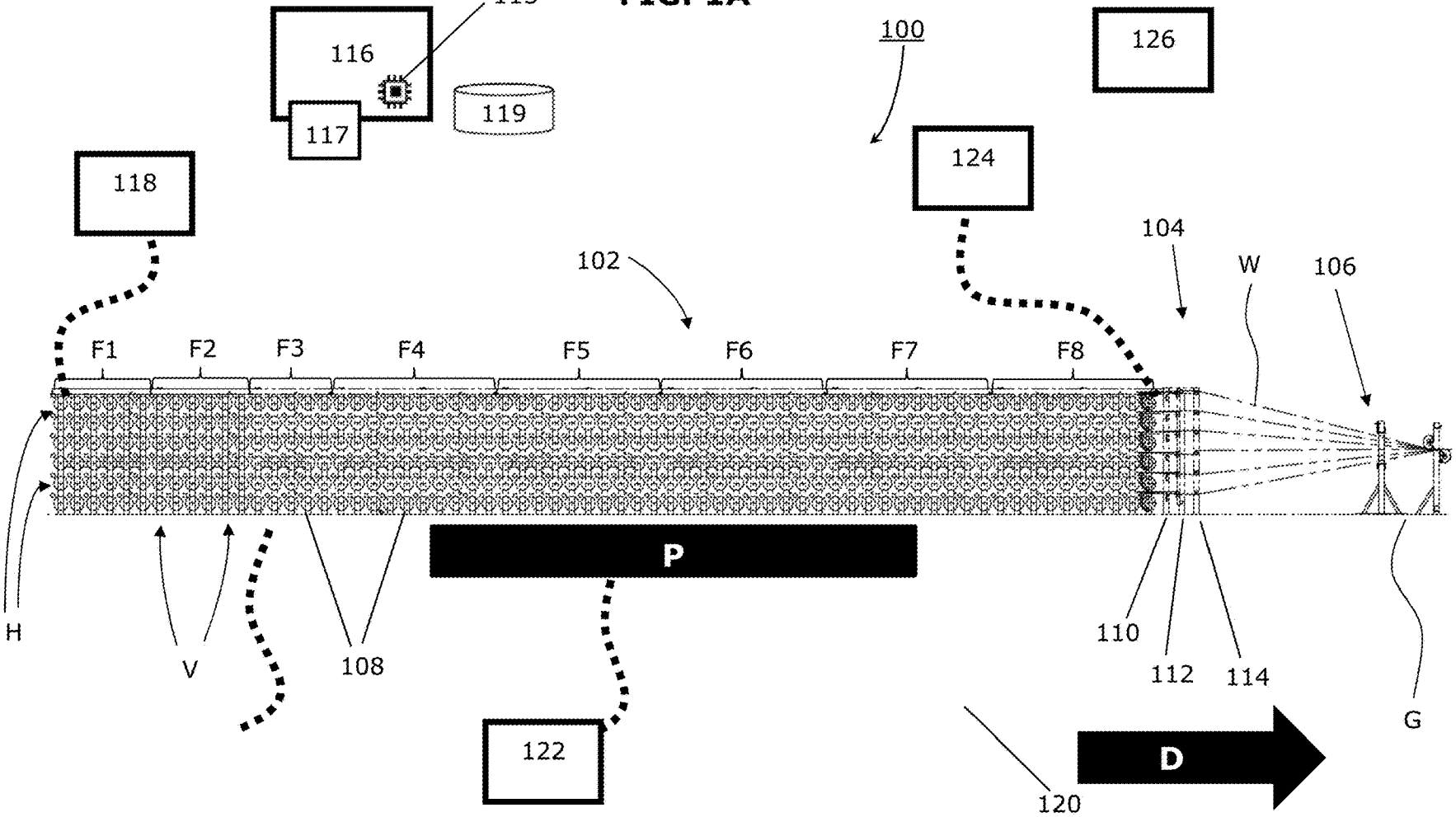
FIGS. 1A-1B are side views of an example creel system that may incorporate the principles of the present disclosure.

The present disclosure is related to creel systems and, more particularly, to digital creel systems that provide real-time optimized feedback, automatic control and increased efficiency.

The embodiments described herein provide a control system for a creel system. The control system is a digital control system integrating multiple creel room processes, which previously functioned independently of each other. In some embodiments, the digital control system integrates together one or more of the following separate functions: (i) servo valve operated air pressure control console (i.e., an APC), (ii) a loose wire detection system (i.e., an LWD), (iii) a shifting platform control (i.e., SPC), (iv) a tension monitoring system (a TMS), and (v) one or more shifting platform safety devices. The digital control system may include one or more sensors for monitoring various parameters of the creel system, such as ambient temperature and/or humidity within the creel room. The digital control system integrates signals associated with the foregoing functions and/or parameters and system controls into a common Industrial Personal Computer (IPC), which may include a touch screen user interface. The digital control system may also allow for user input parameters which are not required for creel room function, but may be desirable for the end user, for example, the size of wire currently being run on the creel system. The IPC may be programmed to include a series of data display screens and control screens navigable by the operator. The IPC may communicate wirelessly or over cables/wires (e.g., Ethernet) and the IPC may include an internal Programmable Logic Controller (PLC) accessible by other customer PLCs. For example, the IPC PLC may be accessible by a calender PLC which sends signals commands to adjust air pressure modifying wire tension in the creel room in addition to monitoring other creel room data. Accordingly, the digital control system permits real-time monitoring of wire characteristics as the wire is un-spooled and fed from the creel system. Other embodiments described herein provide tension control systems utilizable in a creel system that include a sensor that measures the tension in a wire, which the tension control system utilizes to control the rotation of a spool of wire, and thus eliminate or minimize strain or breaking of the wire unspooled therefrom. The digital control system may also be configured to self-adjust based on measured data taken during a creel run, for example, logic may be programmed (e.g., on the IPC) such that a user-specified target tension is maintained throughout the creel run by measuring tension via the TMS, and adjusting the air pressure as required to maintain that tension.

Creel systems provide the mechanism for delivery to a calender or conveyor of cords, typically fabric or steel. The creel system is the first step in the manufacture of textiles or tires because it is important to the quality of the product that the cords be organized and brought together with even tension.

FIG. 1A is a side view of an example creel system 100 that may incorporate the principles of the present disclosure. The depicted creel system 100 is just one example creel system that can suitably incorporate the principles of the present disclosure. Indeed, many alternative designs and configurations of the creel system 100 may be employed, without departing from the scope of this disclosure.

The creel system 100 may be utilized to deliver a plurality of cords, filaments, or wires W, for example, to a calender or conveyor machine (not illustrated). The wires W may comprise various materials, such as, for example, fabric or steel. As illustrated, the creel system 100 may include a creel frame 102, a front organizing stand (FOS) 104, and a main organizing stand (MOS) 106, which are secured on a factory floor or ground G. In some embodiments, the creel frame 102, the FOS 104, and the MOS 106 are installed in a dedicated room commonly referred to as a creel room (not illustrated). The creel system 100 delivers wire W in direction D towards a calendering operation/process (not illustrated) which processes the wire W into a form utilizable in the final product (i.e., tires). In some applications, the frame 102 is comprised of multiple frame segments, side by side, that each operate (one after the other, or in unison) to deliver the wire downstream to the same calendering process, and in such application each side by side frame 102 is referred to as a creel row. FIG. 1A illustrates the creel system 100 comprising a single creel row, however, one or more additional creel rows (with the same and/or different configuration than the first creel row) may be implanted in the system 100. Each of the FOS 104 and MOS 106 provide organization for wires W in a system 100. Eventually, each layer of wires W may be oriented in one flat plane for entry into the calender. The FOS 104 and MOS 106 are utilizable to gradually move the wires W into this position before they leave the creel room.

In some embodiments, the creel frames 102 are mounted on one or more platforms P that are movable and carry the creel frames 102 mounted thereon as they are moved relative to the ground G (i.e., of a creel room). The platforms P may have wheels (e.g., that ride along rails embedded in the ground G of the creel room. The platforms P may be motor driven and controllable, for example, by a shifting platform control (SPC) drive system 122. With multiple creel rows in one system, one creel row can be positioned on the calender centerline while running, and the other creel row (or creel rows) may be positioned off to the side out of the way while being loaded with spools of wire W, such that, when the first creel row completes its run, it may be moved to the side and the next creel row takes its place minimizing calender downtime, and then, the creels rows may be switched again when the second row has finished (and so on). In some embodiments, multiple rows (for example, 2 rows) are positioned in a run position symmetric to the calender center line, in close lateral proximity to one another and, in this example, both creel rows would pay off wire W to the calender in unison; though, in some embodiments a single row is run from a position offset from the calender centerline.

The wires W are provided on reels or spools 108. The creel frame 102 carries the spools 108 and may group or organize them in a series of rows that are vertically spaced (relative to the ground G) from each other. Thus, the wires W are payed-out from the spools 108 in a series of rows, where each such row comprises a bundle wires W. The wire W may be fed downstream in direction D to the FOS 104 and the MOS 106, and then further downstream for calendering. FIG. 1A illustrates an example where the FOS 104 includes a wire tree 110, which may be configured detect loose wires in each row of wires W as they are fed further downstream. The wire tree 110 includes a plurality of detector rods or sensors arranged as branches that each correspond (or align) with a respective one of the rows of wires W, and the detector rods/sensors may be integrated within of a loose wire detection system (LWD System) and placed on either or both sides of the creel frame 102 for detecting the presence of a loose or sagging wire W in the wire rows. Also in the illustrated example, the FOS 104 includes a direction change apparatus 112 for receiving each row of wire W as they pass through the wire tree 110. The direction change apparatus 112 may include a plurality of rollers configured to facilitate change of vertical direction of the wire W and facilitate its downstream delivery to the MOS 106 and any other downstream operations, for example, a downstream calendering operation. In addition, the illustrated example illustrates the FOS 104 includes an organizing board apparatus 114, which may be either an "Eyelet Board" consisting of individual ceramic eyelets arranged in a steel plate, and/or a "Roller Board" comprised of a plurality of vertical and horizontal rollers, which define "Openings" through which the individual (or bundles) of wire W may be directed, and which further facilitates directing the wire W downstream in a particular vector depending on the end use application. Together, the direction change apparatus 112 and roller board apparatus 114 re-direct each row of wires W so that they may be received by the MOS 106. In some examples, the wire tree 110, the direction change apparatus 112, and/or the roller board apparatus 114 are separate (stand-alone) components and/or any one of them may be integral with either the creel frame 102. However, as described below with reference to FIGS. 1B and 1C, the wire tree 110, the direction change apparatus 112, and the organizing board apparatus 114 may be integrated together as a single structure, such as the FOS 104.

In some examples, element 110 of FIG. 1A may be a LWD Upright, element 112 of FIG. 1A may be the Eyelet Board Upright, and element 114 of FIG. 1A may be the DCR Upright. In some examples, element 110 of FIG. 1B may be the LWD upright, but element 112 of FIG. 1B may be the DCR Upright, and element 114 of FIG. 1B may be the Roller Board Upright. In some examples, the LWD Upright, the Eyelet Board Upright, and the DCR Upright may be positioned in that order, rear to front (i.e., DCR being closest to calender). In other examples, for example, where utilizing rollers for the organizing, the LWD Upright, the-DCR upright, and the roller may be positioned in that order, rear to front (i.e., Roller being closest to calender).

In the illustrated embodiments, the creel frame 102 is a structure comprising a plurality of horizontal members H and vertical members V configured to array the spools 108 in a rectangular grid. In other embodiments, however, the creel frame 102 may be differently configured without departing from the present disclosure. Thus, the creel frame 102 may carry the spools 108 in various arrangements or organizations, rectangular or otherwise.

Here, for example, the creel frame 102 carries six rows and sixty-seven columns of spools 108. It will be appreciated, however, that the creel frame 102 may include more or less rows and/or columns of spools 108 without departing from the present disclosure. For example, the creel frame 102 may be taller and include one or more additional rows of spools 108, or may be shorter and include fewer rows of spools 108.

Similarly, the creel frame 102 may be longer or shorter and include more or less columns of spools 108. In embodiments comprising a multitude of columns of spools 108, the creel frame 102 may include discrete frame sections or segments F. As will be appreciated, providing the creel frame 102 in discrete frame sections facilitates shipping and installation of creel frames 102 and provides the end-user the ability to scale creel operations up or down as needed. Here, for example, the creel frame 102 includes eight frame segments F1-F8 that together define an individual creel row, with frame segments F1 and F2 having six rows and six columns of spools 108, frame segment F3 having six rows and five columns of spools 108, and frame segments F4-F8 having six rows and ten columns of spools 108. Accordingly, the exemplary creel system 100 of FIG. 1A includes a single creel row of multiple frames supporting a total of four-hundred and two spools 108. However, the creel system 100 may have various other set-ups without departing from the present disclosure.

Figure 1B:
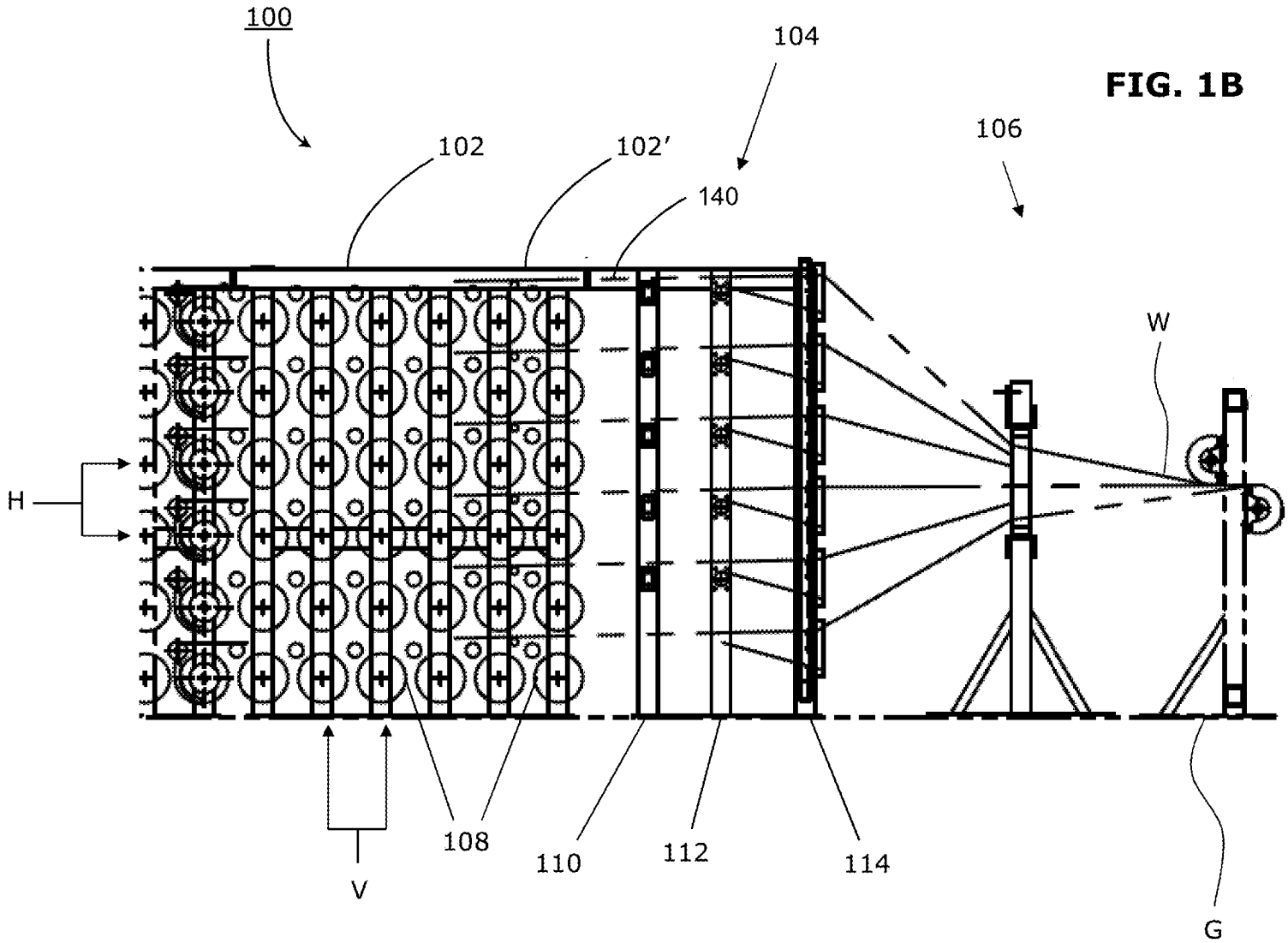

FIG. 1B is a close up view of the front portion of the creel system 100, according to one or more embodiments of the present disclosure. In particular, FIG. 1B illustrates the FOS 104 when installed proximate to a front portion (or flanged end pad) 102' of the creel frame 102, such as a mating flanged end pads. FIG. 1C illustrates the FOS 104 without the creel frame 102. Here, the FOS 104 includes a base 130 on which the wire tree 110, the direction change apparatus 112, and the organizing board apparatus 114 are mounted such that they together define an individual unit.

The wire tree 110 may include a plurality of detector rods 132 extending from the wire tree 110 and configured detect the presence of a loose or sagging wire W. Here, the detector rods 132 are organized to correspond to each row of wire W output from the creel frame 102, and are utilizable with a loose wire detection (LWD) system 124. A sleeve may be provided on any one or more of the detector rods 132 to thereby cover or insulate at least a portion of each particular detector rod 132. For example, insulator sleeves may be provided around a portion (or length) of the detector rods 132 at which they may interact or engage (or be engaged by) the wire W.

The direction change apparatus 112 may include a plurality of direction changing roller assemblies 134 and the organizing board apparatus 114 may include a roller board assembly 136. With this arrangement, the FOS 104 facilitates re-directing (or re-direction of) the rows of wires W into a new (vertical and/or horizontal) direction. In the illustrated example, the FOS 104 also includes a frame extension 140 configured to mount or attach to the creel frame 102, such that the FOS 104 may be secured to the creel frame 102. In some examples, a mounting pad 142 may be included on the top of the FOS 104 frame, which may be utilized in some embodiments to support additional overhead structure. This mounting pad 142 may be provided in multiple sizes and configurations.

The creel system 100 may further include a control system 116 for controlling operation of the various subsystems of the creel system 100. The control system 116 may comprise a IPC that may be installed at various locations proximate to the creel system 100, for example, in the creel room, or may instead be provided at another location segregated or spaced away therefrom (e.g., outside of the creel room and/or in a separate control room). As mentioned below, the creel system may further include an air pressure control (APC) system 118 that, in the illustrated embodiment, supplies pneumatic power to the creel frame 102 via one or more conduits or hoses 120; however, other types of power may be utilized instead or in combination with pneumatic power, such as hydraulic power. The APC system 118 may be provided at various locations relative to the creel system 100 and, in one embodiment, is disposed in the creel room, proximate to the creel frame 102.

The central control system 116 may communicate with various sub-systems, sensors, or devices. For example, the central control system 116 may monitor and control the APC system 118, the SPC drive system 122, the LWD system 124, a tension monitoring system (TMS) 126, and/or various other systems or sensors and aggregate data about overall operation. The central control system 116 may be variously embodied without delineating from the scope of the present disclosure, for example, as an internal Programmable Logic Controller (PLC), personal computer, tablet, smartphone, etc. The central control system 116 may include a processor 115 that may be any of various commercially available processors including, without limitation, a single-core processor, a dual-core processor (or more generally by a multiple-core processor), a digital processor and cooperating math coprocessor, a digital controller, or the like. The central control system 116 may include at least one user interface 117 and/or display configured to present data related to the operation of creel system 100 to a user. The user interface 117 may also allow a user to input commands into the central control system 116 for the monitoring and controlling the various components. In some embodiments, the central control system 116 may be located in a creel room and/or at locations proximate to other control equipment (e.g., calender equipment control interfaces). In other embodiments, the central control system 116 may be mounted on a portion of the creel system 100 itself, such as a portion of the frame 102. In even other embodiments, the central control system 116 is a remote device capable of operating the creel system from a distance, e.g., the central control system 116 is a device located in a room other than the creel room, or is a device held by an operator at a facility where the digital creel is installed or remotely.

The central control system 116 may also include a data storage 119. Implementation of the associated data storage 119 is capable of occurring on any mass storage device(s), for example, magnetic storage drives, a hard disk drive, optical storage devices, flash memory devices, or a suitable combination thereof. The associated data storage 119 may be implemented as a component of the central control system 116, e.g., resident in memory, or the like. The central control system 116 may then save data obtained during operation in a database or log file (event log) within the data storage 119 which may be utilized by operators, for example, to ensure efficient operation of the creel system and/or address logged errors, creating reports, etc.

FIG. 1D illustrates an alternate MOS 106 that is utilizable with the creel system 100, according to one or more embodiments of the present disclosure. In the illustrated example, the MOS 106 is provided on a track 150 to be movable in a path defined by the track 150. Here, the MOS 106 includes a frame 152 and a plurality of wheels 154. The wheels 152 are provided on the frame 152 to ride along the track 150, and thereby constrain movement of the MOS 106 to a path 156 defined by the track 150. Here, the track 150 extends in a direction that is substantially perpendicular to the direction D, such that the path 156 traveled on by the MOS 106 is also substantially perpendicular to direction D as indicated by the arrowheads of the path 156. It will be appreciated, however, that the track 150 may have different geometries for positioning the MOS 106 as may be needed or beneficial in a particular creel setup. For example, the track 150 may be at least partially arcuate. Also, a drive system may be provided for moving the MOS 106 along the track 150. For example, the MOS 106 may include an onboard motor assembly configured to drive one or more of the wheels 154. Thus, the MOS 106 is movable such that it may be selectively aligned with various creel rows. When the MOS 106 is provided as a movable MOS, multiple such MOSs 106 may be utilized and each provided on the tracks, so that while one MOS 106 is running on center with the calender, another one or more MOS 106 is off to the side being loaded in front of another creel row that is not actively running; then, when the run is complete, the loaded MOS 106 can slide over to the center and be ready to run.

The MOS 106 includes a pair of guide roller assemblies 158*a*, 158*b*. In some embodiments, the guide roller assemblies 158*a*, 158*b* include flattening rollers. The guide roller assemblies 158*a*, 158*b* are arranged to take the grid pattern of wires coming through the main roller board, and level them into a flat plane when it exits the stand such that a flat plane of wires is provided as input to the calendering process. Thus, at some point, the wires W may be guided to a flat sheet/plane, either by rollers assemblies 158*a*, 158*b* integrated in the exemplary MOS 106 of FIG. 1D, and/or as a separate roller prior to the calender intake. In some examples, the calender may include a guide roller at the intake to accomplish this. In some examples, the MOS 106 may include one or more additional roller assemblies in addition to the rollers 158*a*, 158*b*, or the MOS 106 may include a single roller assembly.

The MOS also includes a main organizing board assembly 160. The main organizing board assembly 160 may be either a "Main Eyelet Board" comprised of ceramic eyelets in a steel plate, or a "Main Roller Board" comprised of a plurality of vertically oriented rollers and a plurality of horizontally oriented rollers. Accordingly, the wire W may be routed through the main organizing board assembly 160, under (or over) the first guide roller assemblies 158*a* and over (or under) the second guide roller assemblies 158*b*, and then routed out therefrom for further downstream processing (i.e., to the calendar). Depending on which corresponding opening in the front organizing board a given wire W comes from before passing through the main organizing board assembly 160, the wire W may be re-directed downward by a roller in the main organizing board toward the guide rollers 158*a* and 158*b*, or may be re-directed updward by a roller in the main organizing board toward the guide rollers 158*a* and 158*b*, or the wire may pass substantially horizontally through the main organizing board toward the guide rollers 158*a* and 158*b* (e.g., without being re-directed).

Figure 2A:
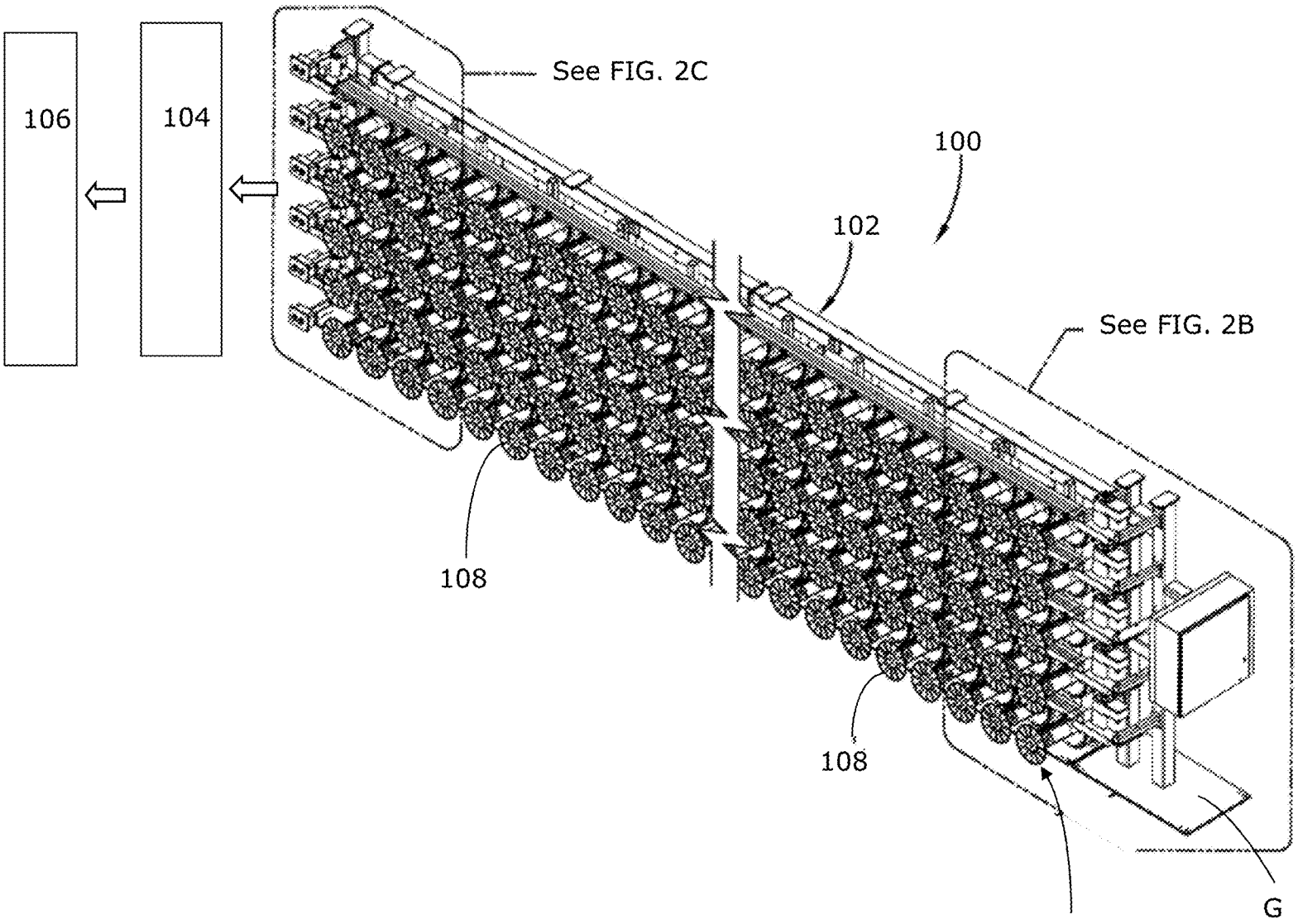
Figure 2B:
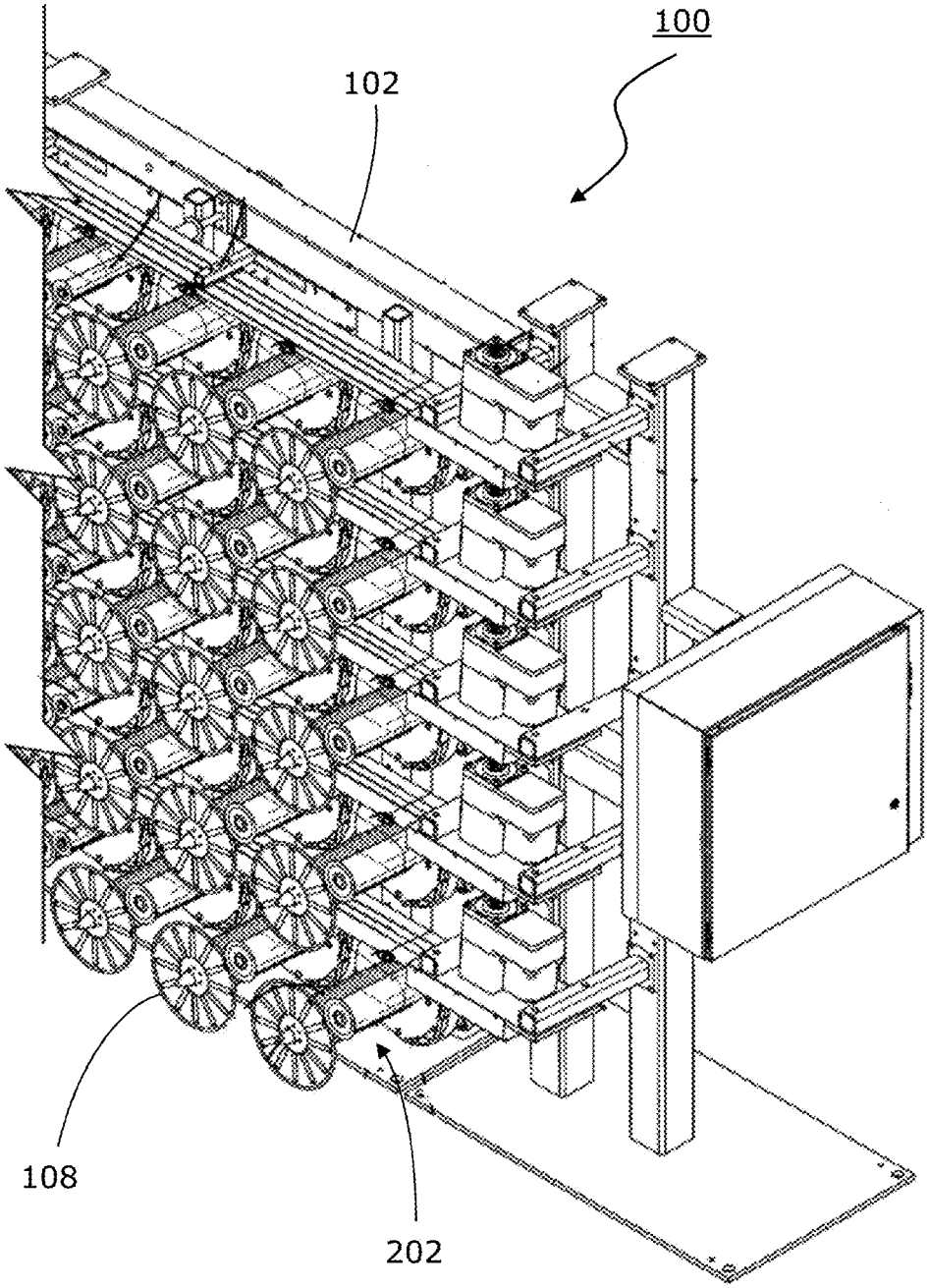
Figure 2C:
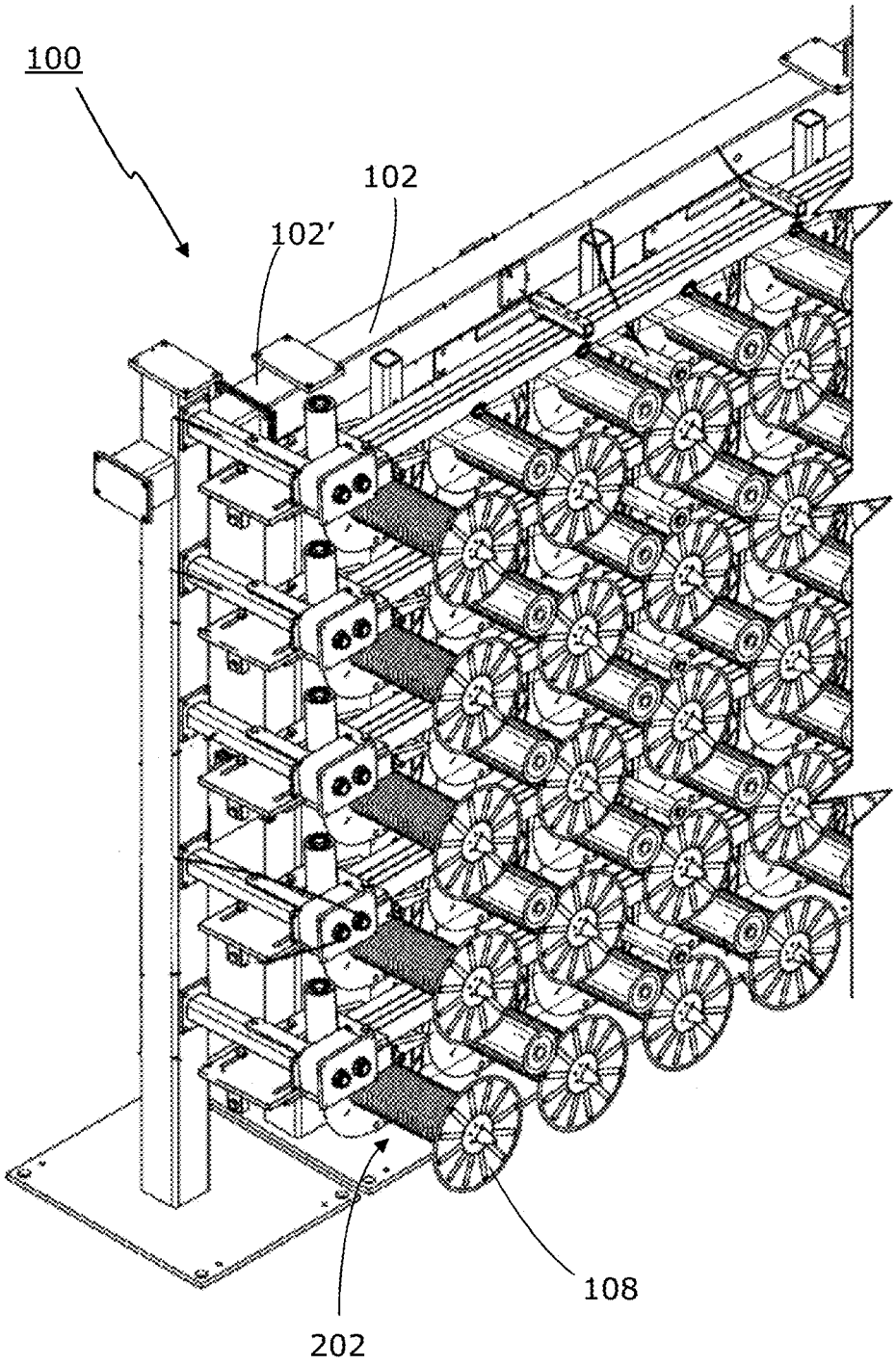

FIGS. 2A-2D are perspective views of the creel system 100 of FIG. 1A, according to one or more embodiments of the present disclosure. More specifically, FIG. 2B is a partial perspective view of a rear end of the creel system 100 of FIG. 2A, whereas FIG. 2C is a partial perspective view of a front or output end of the creel system 100 of FIG. 2A. Furthermore, FIG. 2D illustrates a partial perspective view of a front or output end of the creel system 100 when partially assembled utilizing an alternate creel frame 102, according to one or more embodiments.

As illustrated, the creel system 100 further includes a plurality of tension controller apparatuses 202 that are actuated by the APC system 118. FIGS. 2B and 2C illustrate the frame 102 supporting a plurality of tension controllers 202, whereas FIG. 2D illustrates just two tension controllers 202 installed on the frame 102 (and without spools 108 thereon) to illustrate remaining locations at which tension controllers may be installed/mounted and how input air may be supplied to the tension controllers 202. The tension controller apparatuses 202 are mounted on the creel frame 102 and carry (or hold) the spools 108 such that the wire W may be unwound therefrom for downstream operations and/or processing. The APC system 118 integrates with the tension controller apparatuses 202 and may be used to adjust (i.e., increase or decrease) the tension (or speed) on the wires as the spools 108 unwind (or rotate). Thus, the APC system 118 may cause the tension controller apparatuses 202 to increase friction applied to the spools 108 as they unwind, which provides greater resistance to rotation of the spools 108 and adds tension to the wire W as it is unwound therefrom. A plurality of intermediate support rollers 208 may be provided for helping support and/or direct the wire W.

The APC system 118 may be provided at various locations about the creel system 100. For example, the APC system 118 may be provided in a console that is mounted to a part of the creel system 100, such as the creel frame 102, or, the APC system 118 may be differently provided, such as a stand-alone console that is positionable at various locations.

The APC 118 may be supplied with air regulated to a desired pressure, for example and without limitation, about 10 pounds per square inch (psi) to about 30 psi, including about 30 psi, and including about 25 psi. One or more input lines 204 may be provided for supplying the input air. In some embodiments, a single input line 204 is utilized to feed all tension controller apparatuses 202 in the creel system 100. In other embodiments, a plurality of input lines 204 are utilized, with each such input line 204 supplying input air to a group of tension controller apparatuses 202. In some examples, a network of hoses and lines may be routed throughout the frame to supply the various tension controller apparatuses 202 (or groups of tension controllers 202). For example, the input line 204 may be connected to (and supply input air to) a plurality of manifolds 206, where each of the manifolds 206 is connected to a group of tension controllers 202. Here, each of the manifolds 206 is oriented vertically to supply columns of tension controllers 202 on opposing sides of the manifold 206, where each tension controller 202 in a particular column is fed with supply air through an individual input line 210 extending from the manifold 206.

The APC 118 may include at least one electronically operated valve (servo valve) associated/controlling at least one tension controller apparatus 202. In some embodiments, an electrical signal for actuating each servo valve originates from the calender. In some embodiments, the central control system 116 is configured to actuate each servo valve. In some embodiments, a servo valve is associated/controls a single row of tension controller apparatus 202, e.g., row 604 or column 606 of FIG. 6. By adjusting the output air pressure to each row 604, the central control system 116 can change the tension output of the tension controller apparatus 202, thereby setting the desired tension of the wires W. In some embodiments, the valves are located in a pneumatic panel enclosure that may be positioned adjacent to the main electrical enclosure.

In some embodiments, the central control system 116 receives signals from the calender to set the target air pressure for at least one tension controller apparatus 202. For example, the calender may send an input signal to the control system 116 to govern a pilot-operated regulator, in and, based on the value of that input signal, the control system 116 may then send an appropriate 4-20 mA signal to the servo valve driving the pilot regulator to a target pressure (e.g., determinable via a pressure to tension curve). Thus, the central control system 116 receives and analyzes input signals from the calender and then sends an appropriate electrical signal to the servo valves based on the input signals from the calender.

The central control system 116 may also be configured to send a digital signal back to the calender. The digital signal sent back to the calender may be indicative of a plurality of different parameters, such as, for example the set pressure point received, and/or the actual pressure reading from the servo valve. In some embodiments, the digital signal to the calender also includes the actual pressure reading at each creel row, which may be accomplished through the installation of a sensor and a slave PLC at each creel row to send the data to the central control system 116. The additional data points provide the calender a more accurate representation of the actual realized pressure output based on the input target permitting the calender to be programmed to adjust target pressure based on this downstream feedback. Thus, the control system 116 is beneficial in that, compared to other systems that utilize just one-way communication between the calender and the air pressure control, the control system 116 is able to provide digital signal feedback to the calender as well as providing visual feedback to an operator via the user interface 117.

The control system 116 may display information (e.g., the target pressure, actual valve pressure, and actual creel frame pressure) on the user interface 117. The user interface 117 may comprise one or more touchscreen displays that may be provided at various locations, for example, in a creel room. Upper and lower pressure thresholds may be set/stored in the control system 116 to trigger an alarm state if the pressure deviates outside the acceptable operating limit. The control system 116 may be configured to maintain an event log, accessible to the creel room operator via the IPC touchscreen display, and which log may include a record of air pressure alarm state and activity.

Figure 3A:
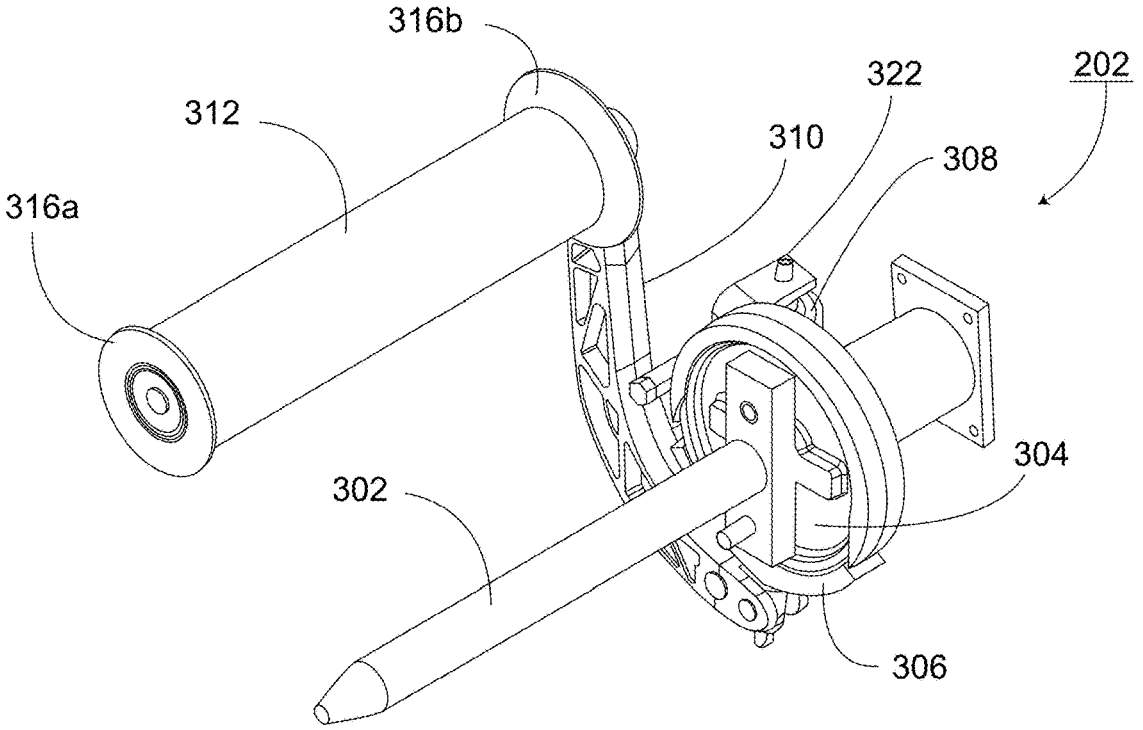
FIGS. 3A-3B are front and rear perspective views of the tension controller apparatuses that may be utilized in FIGS. 1-2.
Figure 3B:
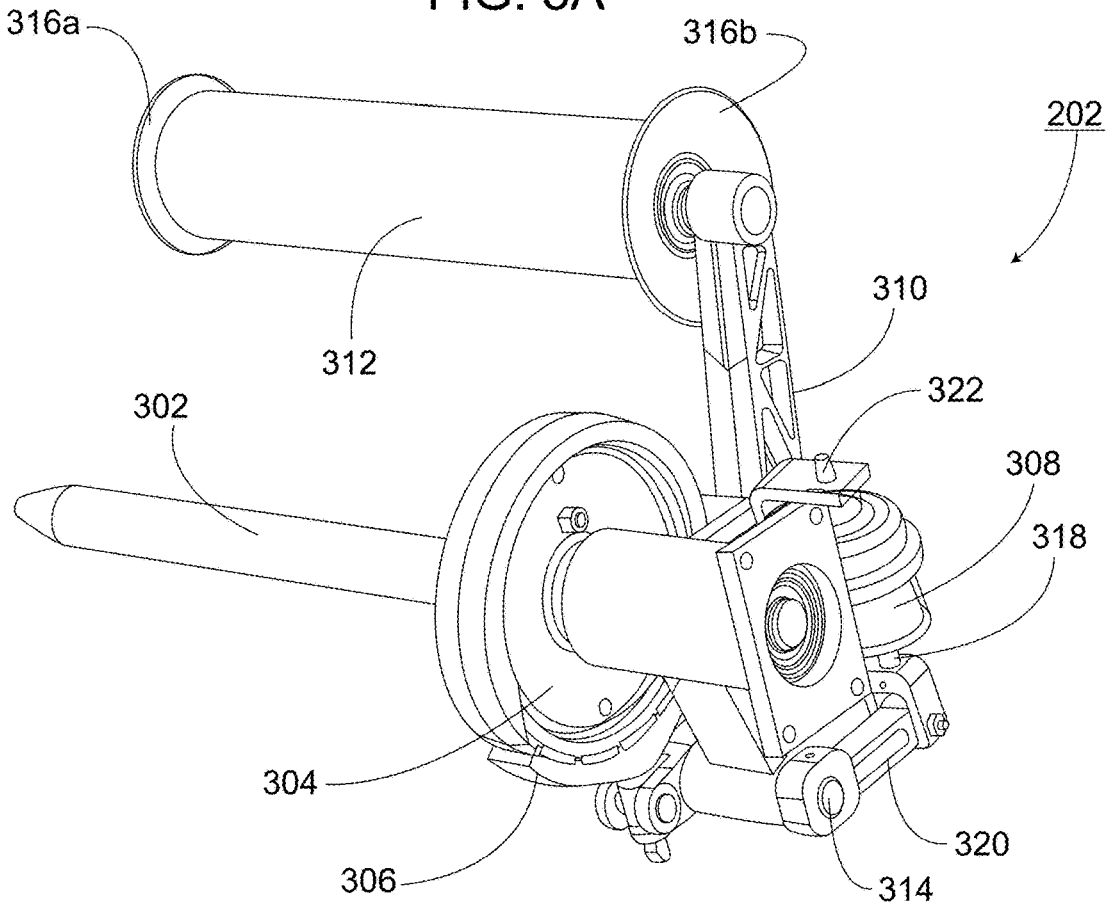

FIGS. 3A and 3B are perspective views of an exemplary tension controller apparatus 202 utilizable with the creel system 100 of FIGS. 1-2, according to one or more embodiments of the present disclosure. As illustrated, the tension controller apparatus 202 includes a spindle 302 that carries the spool 108 (FIGS. 1-2), a brake drum 304, a brake shoe 306, a diaphragm actuator 308, a control arm 310, and a control arm roller 312. The control arm 310 is connected to a pivot shaft 314 and configured to pivot towards and away from the spindle 302. The control arm 310 is also connected to the brake shoe 306 such that the brake shoe 306 is urged into contact with the brake drum 304 as the control arm 310 pivots away from the spindle 302.

The control arm roller 312 is connected to the control arm 310 and thus pivotable toward and away from the spindle 302. The control arm roller 312 extends substantially perpendicular to the control arm 310 and substantially parallel with the spindle 302 and the spool 108 mounted thereon. Here, the control arm roller 312 is configured as a smooth cylindrical drum over which the wire W may pass, and is dimensioned to be at least as long as an axial length of the spool 108 to insure the smooth and uniform withdrawal of the wire W from the spool 108 without fouling or substantial deflection. As the wire W is payed out from the spool 108 and passes over the control arm roller 312, the wire W may be maintained thereon by a pair of lateral flanges 316*a*, 316*b*.

The diaphragm actuator 308 is connected to the APC system 118 and is configured for pneumatic operation as hereinafter described. A piston 318 extends from a lower end of the diaphragm actuator 308. The piston 318 is pivotally fixed to a brake arm 320, and the brake arm 320 is fixed to the pivot shaft 314 such that rotation of the brake arm 320 rotates the pivot shaft 314 and the control arm 310 attached thereto. The diaphragm actuator 308 is supplied with fluid (e.g., air) at its upper end via a port 322 that may receive a hose (not illustrated) or other conduit leading from the APC system 118. As will be appreciated, the port 322 may be interconnected to a manifold (not illustrated) which services a plurality of tension controller apparatus 202, and application of the fluid via the APC system 118 causes actuation of the piston 318 relative to the diaphragm actuator 308.

In operation, the spool 108 of wire W is mounted on the spindle 302, and an end of the wire W is led from the top of the spool 108, under and around the control arm roller 312 in a clockwise direction (in FIG. 3A) and to a downstream take-up mechanism (not illustrated). Prior to actuating the downstream take-up mechanism, the control arm 310 and the control arm roller 312 will repose, displaced from the spool 108. At this time, the brake shoe 306 is urged into engagement with the braking surface of the brake drum 304, thereby arresting rotation of the brake drum 304 and the spindle 302 connected thereto, so that the wire W cannot be payed-out from the spool 108 that is mounted on the spindle 302.

As the wire W is taken up, the control arm 310 and control arm roller 312 will rotate toward the spool 108 and, in so doing, will move the brake shoe 306 away from the brake drum 304. Such movement of the brake shoe 306 relative to the brake drum 304 will reduce the friction force between the brake shoe 306 and the braking surface of the brake drum 304, thereby permitting rotation of the brake drum 304, the spindle 302, and the spool 108 mounted on the spindle 302. The force exerted on the control arm 310 by the wire W (when engaging the control arm roller 312) is balanced against the friction between the brake shoe 306 and the braking surface of the brake drum 304 to maintain a constant tension in the wire W. The tension from this force-balance system is, within normal operating limits, independent of the coefficient of friction between the braking surfaces of the brake drum 304 and the brake shoe 306. In the event the take-up decreases in rate or ceases, the requisite amount of braking is immediately applied so there is never any undesirable slack created in the wire W. Likewise, upon an increase in the rate of take-up, the balance between the braking force and the force applied by the diaphragm actuator 308, permits a smooth and uniform rate of payout without stretching or jerking of the wire W.

Application of air pressure to the diaphragm actuator 308 via the APC system 118 actuates the piston 318 extending therefrom, thereby urging the brake arm 320 to rotate (counter-clockwise in FIG. 3A and clockwise in FIG. 3B). Such rotation of the brake arm 320 produces a torsional force about the pivot shaft 314 that in turn urges the brake shoe 306 into engagement with the braking surface of the brake drum 304, thereby producing a desired tension force in the wire W. Since this torsional force must be overcome by the force exerted on the control arm 310 by the control arm roller 312, as produced by the tension in wire W, before the control arm 310 rotates (clockwise in FIG. 3A and counter-clockwise in FIG. 3B), it constitutes a biasing force substantially proportional to the tension in the wire W.

Figure 4:
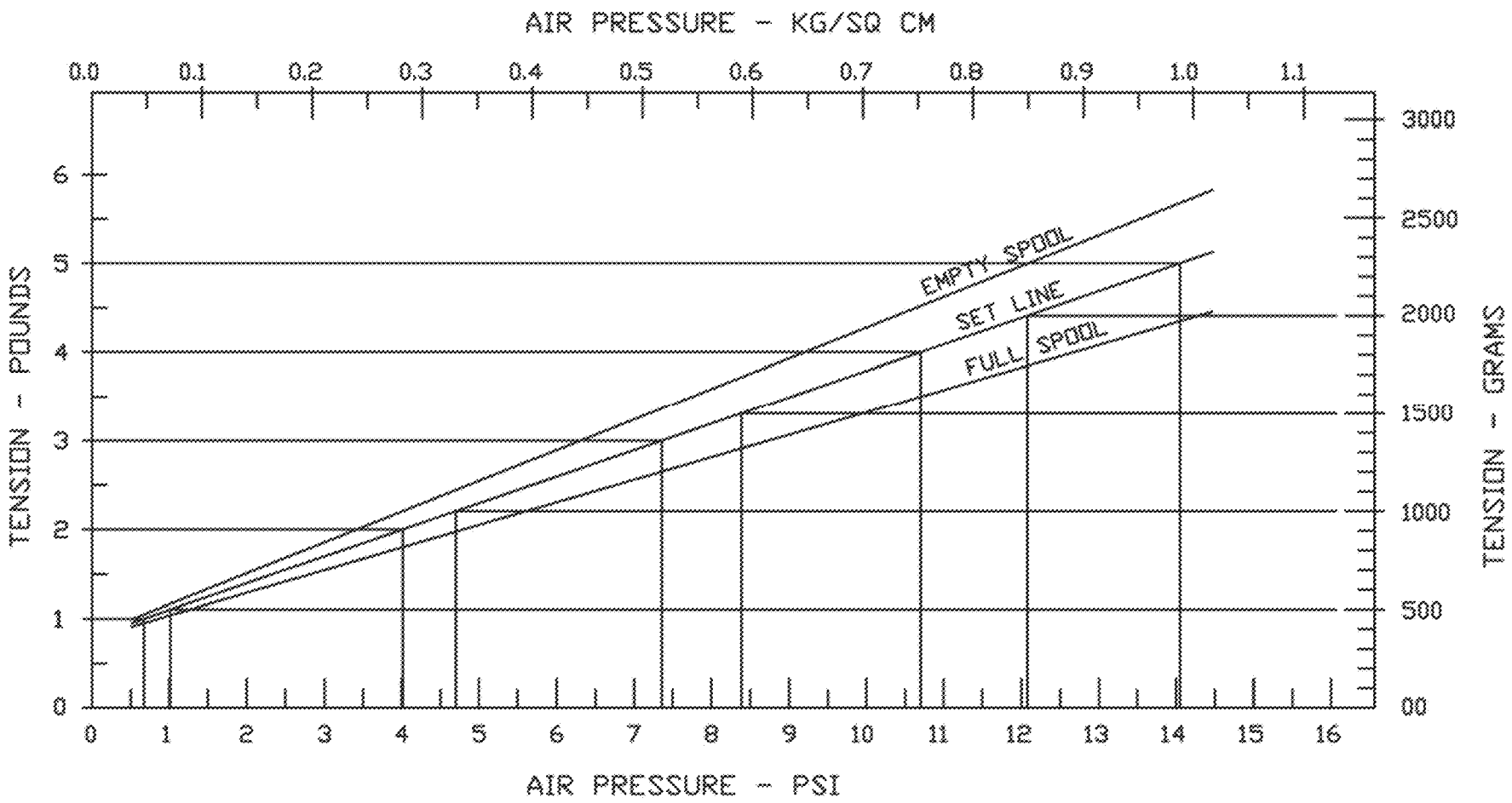
FIG. 4 is a curve showing the relationship between air pressure and wire tension in the tension controller apparatus of FIGS. 3A-3B.

Thus, the tension in the wire W may be adjusted by controlling the air pressure in the diaphragm actuator 308. FIG. 4 is a curve showing the relationship between air pressure and wire tension (i.e., tension of a wire W) in an exemplary tension controller apparatus 202, according to one or more embodiments. More specifically, FIG. 4 is an air pressure verses wire tension operating curve that may be utilized to control the tension in a wire W by adjusting the air pressure supplied to the diaphragm actuator 308. The operating curve of FIG. 4, however, may vary depending on a number of factors, including but not limited to, the amount of wire W on the spool 108 (i.e., whether the spool 108 is full or empty), the weight of the spool 108, the operating speed, and the tension controller apparatus 202 utilized.

The creel system 100 may include various sensors and/or detection systems that monitor the wires W and the environmental conditions present in the creel room during operation. For example, the creel system 100 may include a wire W detection system that detects broken or loose wires W encountered in each row of wires W (i.e., the "LWD System"). In addition, the creel system 100 may include a tension monitoring system ("TMS") 126 for detecting and measuring tension in the wire W. The creel system 100 may include one or more additional sensors for measuring various other aspects of the creel system 100, including environmental parameters and/or operational parameters associated with the creel system 100. For example, the creel system 100 may include an environmental monitoring system (not illustrated) that includes one or more sensors for measuring conditions of the creel room such as temperature, humidity or moisture, and/or atmospheric pressure. As hereinafter discussed, the control system 116 may include software that permits the operator thereof to modify or control various operating parameters of the creel system 100 in response to the information gathered via the foregoing sensors and/or detection systems. Thus, the operator may fine-tune the tension of the wire W and/or fine-tune the environmental conditions experienced within the creel room.

Figure 5:
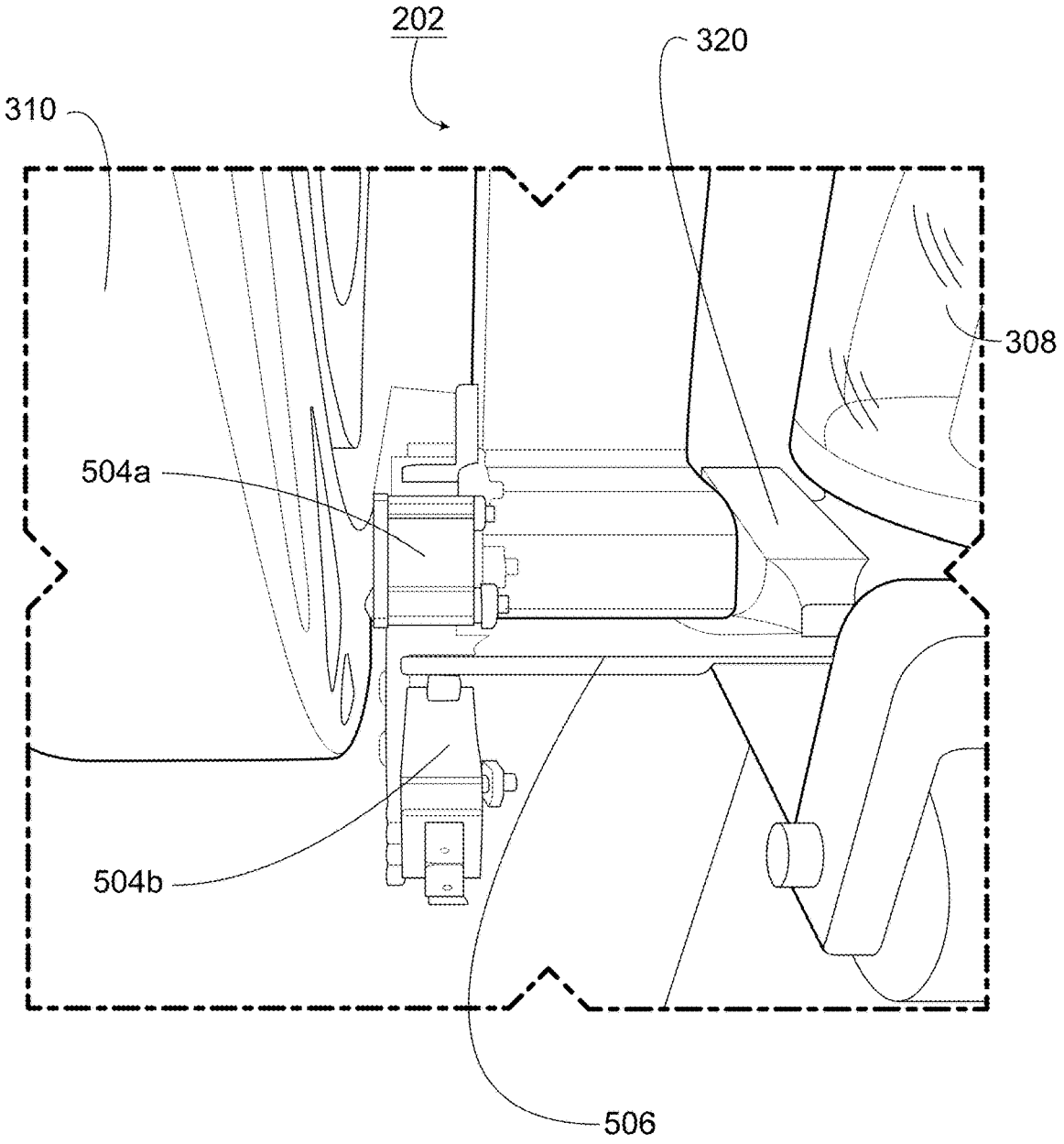
FIG. 5 is a close-up view of the tension controller apparatuses of FIGS. 3A-3B.

FIG. 5 is a close-up view of the tension controller apparatus 202 of FIGS. 3A-3B configured with limit switches, according to one or more embodiments of the present disclosure. The depicted arrangement of switches is just one example arrangement that can suitably incorporate the principles of the present disclosure. Indeed, many alternative designs and configurations of switches may be employed, without departing from the scope of this disclosure.

Here, a pair of limit switches 504*a*, 504*b* is provided on the tension controller apparatus 202, and a switch blade 506 that is connected to the brake arm 320 of the tension controller apparatus 202. The limit switches 504*a*, 504*b* may comprise various types of limit switch, such as the MICRO-SWITCH V3-1101-D8 or V7-2617D8. As the brake arm 320 rotates (with the control arm 310) about the pivot shaft 314 (FIGS. 3A-3B) in response to a change in the tension imparted by the wire W on the control arm roller 312 (FIGS. 3A-3B), the switch blade 506 may reciprocate between the limit switches 504*a*, 504*b*. When the brake arm 320 rotates a sufficient degree clockwise or counter-counter-clockwise to the bounds of the normal operating range (e.g., to either the lower or upper bound of the range 0-35°), the switch blade 506 engages one of the limit switches 504*a*, 504*b* thereby indicating that either tension in the wire W is too high or tension in the wire W is too low indicating that the wire W is loose or broken. In other embodiments, a single limit switch (not illustrated) may be utilized to measure whether the tension is too high or whether the wire W is loose or broken. The single limit switch, for example, could be engaged by the brake arm 320 as the brake arm 320 rotates within normal operating limits (e.g., between the range 0-35°), but become disengaged when the brake arm 320 rotates in either direction outside of the normal operating limits. These embodiments, however, do not provide wire W tension measurements between the limits defined by the limit switches 504*a*, 504*b* (e.g., between the upper and lower bounds of the range 0-35°).

The limit switches 504*a*, 504*b* (or the single limit switch) may comprise various types of switches or sensors, as known in the art. Regardless of type, however, they may be configured to communicate with the user interface 117 (FIG. 1) as hereinafter described. When engaged, for example, the limit switches 504*a*, 504*b* may supply a signal to actuate a transmitter (not illustrated) provided on the creel frame 102. The transmitter communicates with a remote receiver (not illustrated) disposed in the user interface 117, which may in turn produce an audio or video indication (or both) to remotely indicate that the tension in the wire W is too great or that the wire W is too loose or broken. The signal transmitted from the transmitter to the remote receiver may be coded to uniquely identify signals from a plurality of tension controller apparatuses 202.

Various other devices or tension sensors may be utilized to monitor tension in the wire W instead of, or in addition to, the limit switches 504*a*, 504*b*. For example, one or more additional tension sensors may be utilized, such as a TE-24 Check-Line® heavy-duty tension sensor manufactured by Electromatic Equipment Company, Inc. (each, a "TE-24 sensor"). In one such embodiment, one TE-24 sensor is utilized for each of the tension controller apparatuses 202. In other embodiments, however, one or more TE-24 sensors are utilized to monitor the tension of wires W of a group of tension controller apparatuses 202 (e.g., a row of tension controller apparatuses 202). Thus, the TE-24 sensor may be utilized to measure a group of wires W, though the TE-24 sensors may locally influence the wire W tension as they are routed through its wheeled measurement mechanism. The TE-24 sensor, or any of them, may be provided at various locations about the creel system 100, for example, at the front of the creel frame 102 and/or proximate to the FOS 104. As mentioned above, the TE-24 sensor(s) may be utilized in addition to, or instead of, the limit switches detailed above. Also, it will be appreciated that tension sensors other than the TE-24 sensor may be utilized without departing from the present disclosure.

In another example, one or more tension sensing rollers may be utilized, such as the TSR-3 or TSR-4 Tension Sensing Roller manufactured by The Montalvo Corporation (each, a "tension-sensing roller"). In one such embodiment, a single tension-sensing roller is utilized for each row of tension controller apparatuses 202. In this manner, each tension-sensing roller would provide an average reading of the tension of all wires W in the row rather than providing unique tension readings of the individual wires W in the particular row, and thus might not provide feedback of a variance in tension that would necessitate a shutdown (e.g., where 1 to 3 wires W are loose). As mentioned above, the tension-sensing roller(s) may be utilized in addition to, or instead of, the TE-24 sensor(s) and/or the limit switches detailed above. Also, it will be appreciated that tension-sensing rollers other than the TSR-3 or TSR-4 Tension Sensing Rollers may be utilized without departing from the present disclosure. For example, a tension-sensing roller that may measure each individual wire passing there over may be utilized.

In even other embodiments, tension of a wire W may be determined based on the position of the control arm 310 (or control arm roller 312) associated with that wire W via a position sensor (the "Position Sensor"). In some of these embodiments, the Position Sensor is an instrument that measures angles of slope and inclination with respect to gravity. Accordingly, the Position Sensor may comprise various types of instruments, including but not limited to inclinometers, tilt sensors, accelerometers, gyroscopes, and combinations thereof, and may take measurements in one, two, or three axes. In one example, the Position Sensor is an inclinometer that is mounted to the control arm 310 (or the control arm roller 312) and configured to determine the angular position thereof within its full range of motion (e.g., 0-35°). In even other embodiments, the Position Sensor is an inductive sensor that may determine the distance that the control arm 310 (or the control arm roller 312) has traveled relative to a stationary reference point (e.g., on the tension controller apparatus 202) to determine its angular position within the full range of motion. Moreover, a rotational encoder/sensor or similar device may be provided on any or each of the tension controller apparatuses 202, in addition to or instead of any of the above, to carry out the same measurements.

After determining the position of the control arm 310 (or control arm roller 312) via the Position Sensor, that information may be utilized to extrapolate a corresponding wire W tension from an operating curve such as that provided in FIG. 4. For example, knowing the full range of motion of the control arm 310 (e.g., 0-35°), it may be determined that the wire W is broken when the control arm 310 is fully forward or that the wire W is overly tight when the control arm 310 is fully rearward, and intermediate wire W tension conditions may be determined by correlating an intermediate angular position there-between (i.e., when the control arm 310 is between the fully forward and fully rearward positions) with a tension obtained from an operating curve (e.g., FIG. 4) based on air pressure. With this information (i.e., feedback), the creel system 100 may automatically adjust the air pressure provided to any individual or groups of tension controller apparatuses 202 as needed via the APC system 118 to optimize operation. In other embodiments, an operator of the creel system 100 may utilize this information to manually adjust the air pressure provided to any individual or groups of tension controller apparatuses 202 as needed via the APC system 118.

Figure 6:
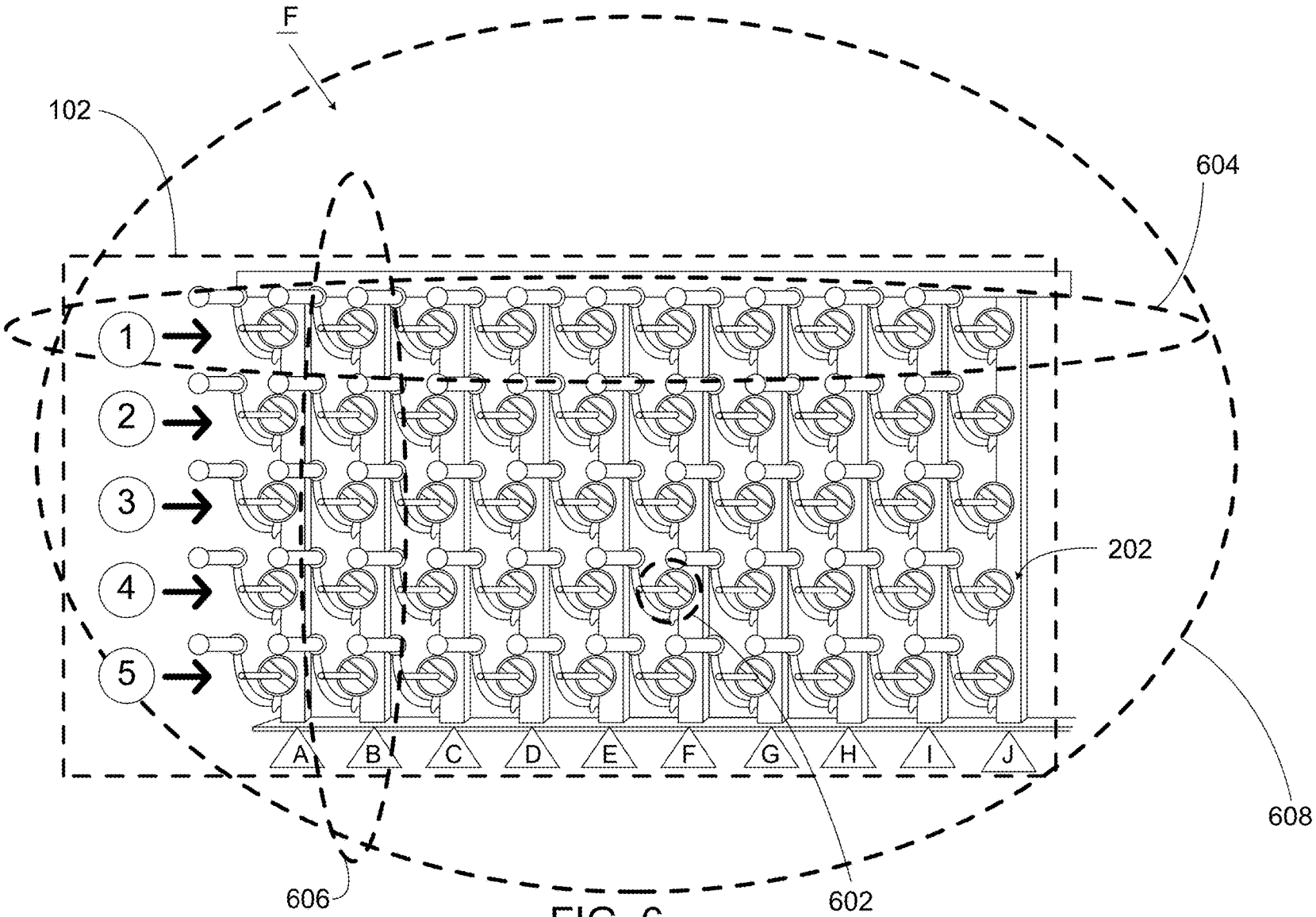
FIG. 6 is an exemplary frame of the creel system that illustrates example zones of tension controller apparatuses that may be controlled as a group.

Moreover, when paired with either or both of the tension-sensing roller(s) and the TE-24 sensor(s) detailed above, the Position Sensor's measurements may be correlated to obtain tension feedback from one or more tension controller apparatuses 202, independently (see FIG. 6); and then a table incorporating appropriate values (e.g., for tension, wire type, spool package, feed rate, etc.) at a set air pressure may be used to check the tension controller apparatuses 202 individually, in pre-determined zones (e.g., rows or columns), or in the entire creel system 100, as described below with reference to FIG. 6.

The creel system 100 may, thus, be modified to control automatically any or all of the tension control apparatuses 202 and thereby fine-tune the tension of the wires W. FIG. 6 illustrates a single frame F that may be incorporated into the creel frame 102 and the various zones of the frame F that may be independently controlled, according to one or more embodiments. In some embodiments, for example, each tension control apparatus 202 is provided in an individual zone 602 such that the creel system 100 may automatically controls each tension controller apparatus 202 individually. In other embodiments, each row of tension controller apparatuses 202 are organized as a zone 604 such that the creel system 100 may automatically control each row of tension controller apparatuses 202 as a group. Similarly, each column of tension controller apparatuses 202 may be organized as a zone 606 such that the creel system 100 may control automatically each column of tension controller apparatuses 202 as a group. In even other embodiments, all tension controller apparatuses on the frame are organized as a zone 608 so that the creel system 100 may control automatically the tension controller apparatuses 202 on each frame F (e.g., on frame F1) as a group independently from the tension controller apparatuses 202 on the other frames F (e.g., frames F2-F8); and in even other embodiments, all tension controller apparatuses 202 on the creel frame 102 are organized as a single zone (not illustrated) such that the creel system 100 may control automatically all of the tension controller apparatuses 202 on the creel frame 102 as a group. As mentioned above, in these or other embodiments, the creel system 100 may provide an operator thereof the ability to manually control the tension controller apparatuses 202 individually or in any number of groupings.

LWD systems may be integrated within various types of creel systems. As described herein, creel systems may comprise one or more creel rows, with each such creel row being a frame structure and a number of rows of tension controllers (e.g., four to six) mounted on both sides (i.e., the left-hand and right-hand) of the frame structure. All wires for a given row of tension controllers on a particular side of the frame are routed through an organizing board at the front of the creel row. In the course of operation of the creel, all the wires in each row and side will flow through a similar path.

Figure 7:
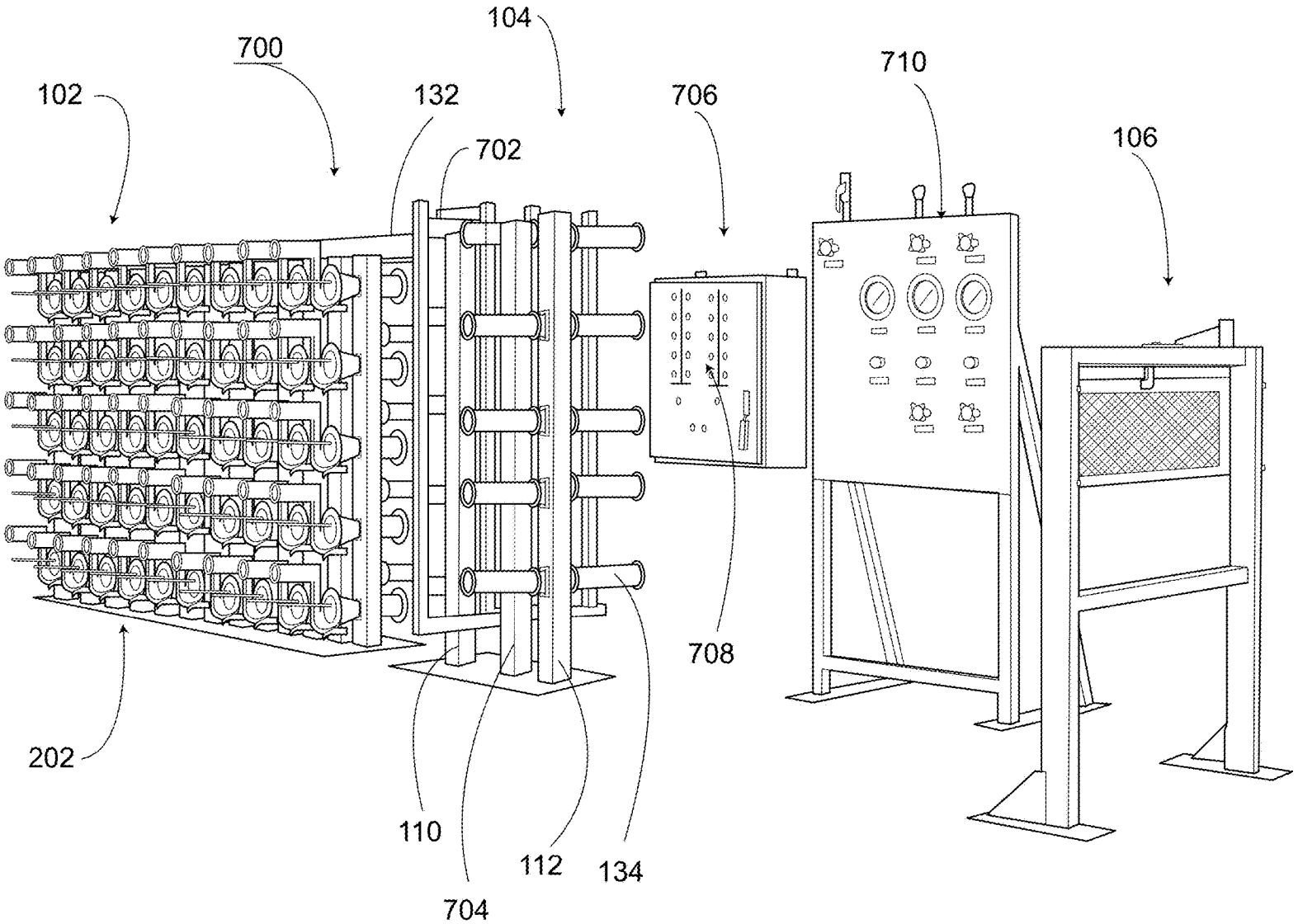
FIG. 7 is a perspective view of an alternate exemplary creel system that may incorporate the principles of the present disclosure.

FIG. 7 illustrates an alternate example creel system 700 incorporating the LWD system, according to one or more embodiments. It should be appreciated that, while the FOS 104 illustrated in FIG. 7 is different than the FOS 104 described with reference to FIG. 1C, the FOS 104 of FIG. 1C may be integrated within the system of FIG. 7 and vice versa, as the subject matter of the present disclosure may be utilized with various types of FOS designs. The LWD system is integrated within the creel system 700 illustrated in FIG. 7, with all wires W for a given row of tension control apparatuses 202 on a side of the frame 102 being routed through an organizing board, such as the organizing board 702 mounted on stand 704 provided between the wire tree 110 and the direction change apparatus 112, at the front of the creel row. In the course of operation of the creel system 700, all the wires in each row and side will flow through a similar path. Here, the LWD system utilizes a plurality of loose wire sensor rods, such as the detector rods 132, which are placed near the organizing board 702, a few inches below the flow path of the wire W for a particular row of tension controllers 202 on a side of the frame 102. The detector rods 132 may be insulated from the wire tree 110 and/or the frame 102, and be arranged such that (at least) detector rod 132 is positioned to correspond with each row of tension controllers 202 on each side of the frame 102. The detector rods 132 are mountable at various locations about the creel system where they are sufficiently proximate to a flow path of the wire W for a particular row of tension controllers 202 for a particular wire W in that particular row of tension controllers 202. For example, the detector rods 132 may be provided on or about the FOS 104 (see, e.g., FIG. 1C and FIG. 7) and/or on or about the frame 102. The loose wire detection rods 132 may detect when an individual one of the individual wires W has broken and fallen into contact with the detection rods 132. In some examples, the loose wire detection rods 132 may detect loose/broken wires by closing a circuit to ground through the steel wire; however, in some embodiments, detection rods 132 may be differently configured such that they detect when a predetermined number of wires has broken or fallen into contact therewith. Also in the illustrated example, the LWD system includes an electrical enclosure/cabinet 706 that is connected to each of the detector rods 132, and the electrical enclosure/cabinet 706 includes an indicator panel 708 that alerts the operator when one of the wires W has become loose enough such that it contacts one of the loose wire sensor rods 132.

In the course of creel operation, not uncommonly a wire W breaks by an upstream snag or a defect in the wire W and, in this instance, the tension control apparatus 202 no longer maintains tension on the end of that wire W, allowing the wire W to sag and contact the detector rod 132. This contact closes a circuit from the detector rod 132 to the electrical enclosure/cabinet 706, thereby providing indication on the indicator panel 708, for example, by activating a light and/or sounding a horn, etc. Based on which light is illuminated on the indicator panel 708, the creel room operator can determine which row and side of the frame 102 the broken wire W is located. With that information, the operator can locate the broken wire W and manually determine which spool has the broken wire W and take appropriate action.

Embodiments of the control system 116 described herein may be integrated into various creel systems, including but not limited to the creel system 700 of FIG. 7. The control system 116 may be utilized in combination with the electrical enclosure/cabinet 706 or the control system 116 may replace the electrical enclosure/cabinet 706. FIG. 7 also illustrates an exemplary enclosure 710 that, for example, may house aspects of the APC 118, the SPC drive system 122, or other control features or safety features associated with creel systems. System air pressure is manually controllable via a pneumatic manifold system located in the APC enclosure panel, and an air pressure set point is also received from the calender room controlling the servo-operated pressure valve. Three pressures are monitored: Calender room set point, APC valve feedback and Frame pressure.

Thus, the LWD system may be in communication with the central control system 116. For example, the LWD may include one or more slave PLCs, with each creel frame 102 being associated with an individual slave PLC (i.e., a slave PLC provided for each creel frame 102). Here, each slave PLC may send to the central control system 116 signal data for each detector rod 132 associated with the particular frame 102 with which the slave PLC is associated. Thus, when a loose or broken wire W is detected (i.e., via contact with the detector rod 132), the LWD system sends a signal to the central control system 116 which in turn triggers an alarm/indication. That is, the user interface 117, or a display associated with the user interface display 117, may show a graphic representation of the stacked detector rods 132, highlighting the particular sensor rod 132 that detected the broken wire W. This information may also be recorded to the storage device 119 in the form of an event log. In addition, the central control system 116 may send a signal to the calender, where such signal is indicative of the status of each of the detector rods 132. In this way, the calender operator has the option to act in response to a broken wire. Accordingly, the control system 116 may provide signal feedback to the calender.

Figure 8B:
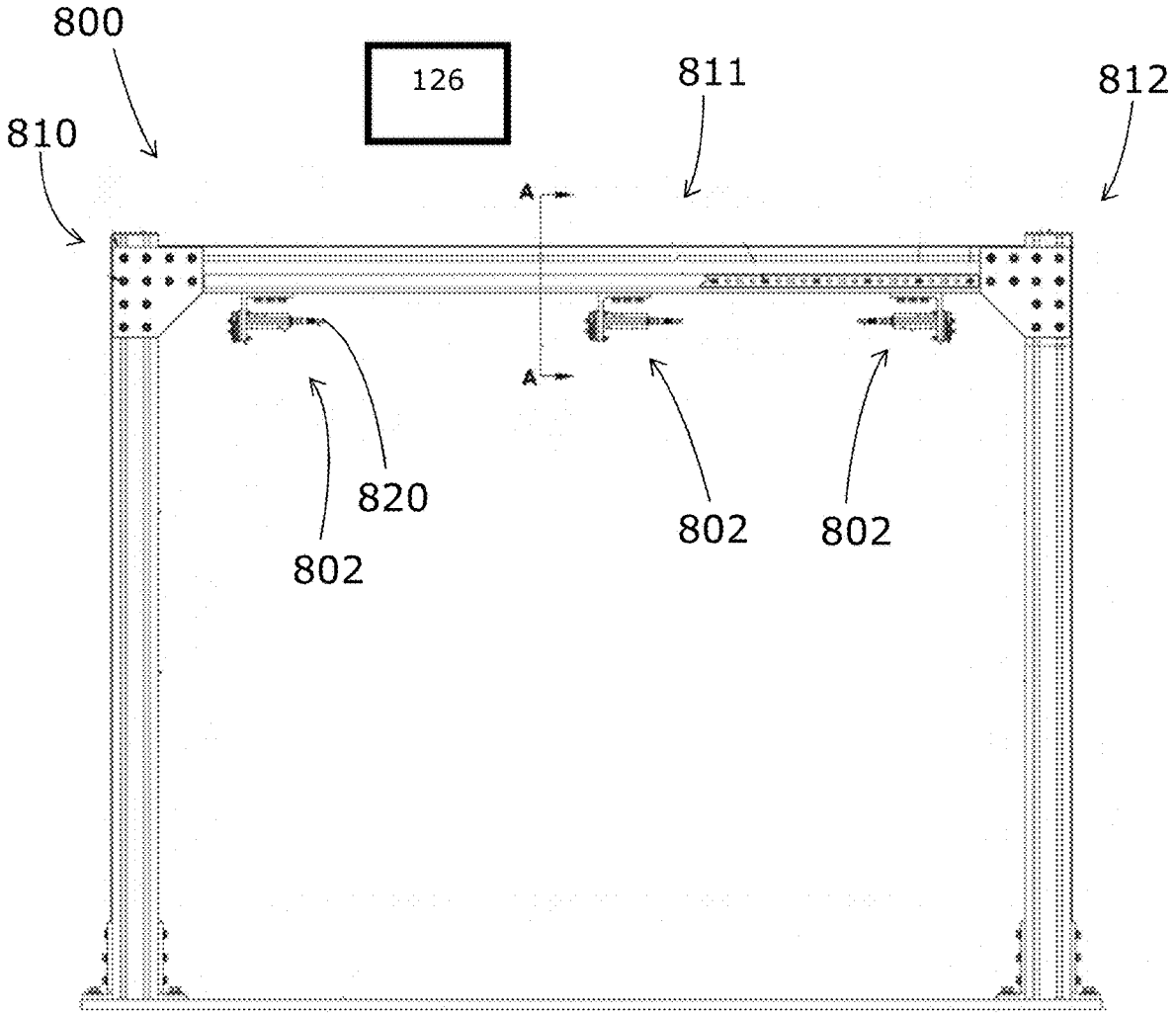

FIGS. 8A-8D illustrate exemplary aspects of the tension monitoring system (TMS) 126, according to one or more embodiments of the present disclosure. In the illustrated embodiment, the TMS 126 includes a tension monitoring stand 800. The tension monitoring stand 800 may be positioned at various locations, for example, it may be located in the creel room at a location proximate to where the wires W are exiting the creel room and traveling into the calender (i.e., the calender window). Thus, the tension monitoring stand 800 may be located after the MOS 106 (i.e., downstream from the MOS 106) such that at least one wire W from the MOS 106 is guided or travels through the tension monitoring stand 800. In some embodiments, the wires W are fed through a top portion of the stand 800. The TMS includes one or more individual tension measuring sensors 802 that each measure tension of a wire W by routing the wire W through a plurality of grooved rollers 804. The tension monitoring stand 800 is positionable over the wire ply, which wire ply may comprise a plurality of individual wires W, e.g. 600-1200 individual wires W. In some embodiments, three tension measuring sensors 802 are positioned along a width of the TMS stand 800 (as shown in FIG. 8B) such that at least one wire W each from the left 810, center 811, and right side 812 of the wire ply can be measured (as shown in FIG. 8C).

While FIGS. 8A-8D illustrate an exemplary design of the tension monitoring stand 800 measuring tension on 3 discrete wires, the tension monitoring stand 800 may be differently configured to measure tension on a different number of discrete wires (i.e., more or less than 3 wires). For example, the tension monitoring stand 800 may be configured to measure total tension across all wires, for example, as an average of all wire tensions, and such tension monitoring stand may be integrated with a MOS or provided as a stand-alone device.

The TMS is in electronic communication with the central control system 116. For example, one or more of the tension measuring sensors 802 may include a cable connector 820, or output leads, such that it may be hardwired to the central control system 116. In some examples, at least one of the tension measuring sensors 802 is in direct or indirect wireless communication with the central control system 116. The tension measuring sensors 802 generate a tension output signal that is sent to the central control system 116, for example, a 4-20 mA tension output signal that is indicative of wire tension. The control system 116 makes available the tension values measured by the tension measuring sensors 802 with a data address for the calender to be readable at any time. Calender equipment logic is able to measure the actual tension output for a specified air pressure input signal. This feedback loop allows the calender to make small adjustments to the air pressure input signal based on the measured tension output providing the calender a more precise method of tension control. The central control system 116 may output the tension measurements, for example, on the IPC touchscreen display, and such IPC touch screen may be made available for the creel room operator to monitor the tension in the wires W.

The user-interface 117 may have various configurations. In some embodiments, for example, as illustrated in FIG. 7, the user-interface 117 includes a relay logic circuit with each output thereof being controlled by a combination of input or output conditions, such as input switches and/or control relays. In other embodiments such as those described with reference to FIG. 9, the user-interface 117 includes a controller 116, which receives signals from the various sensors and/or detection systems (i.e., that monitor the wires W and the environmental conditions present in the creel room during operation) to provide control signals to, for example, the LWD system, and/or the environmental monitoring system. The controller and these various sensors and/or detection systems may communicate by any suitable wired or wireless means. Thus, the user-interface 117 may be configured to provide the operator ability control operation of the creel system 100 during operation. For example, the central control system 116 may be configured to provide the operator of the creel system 100 visual and/or audible performance information in real-time and then receive commands from the operator such that the operator may make corrective inputs and/or optimize performance.

Figure 9A:
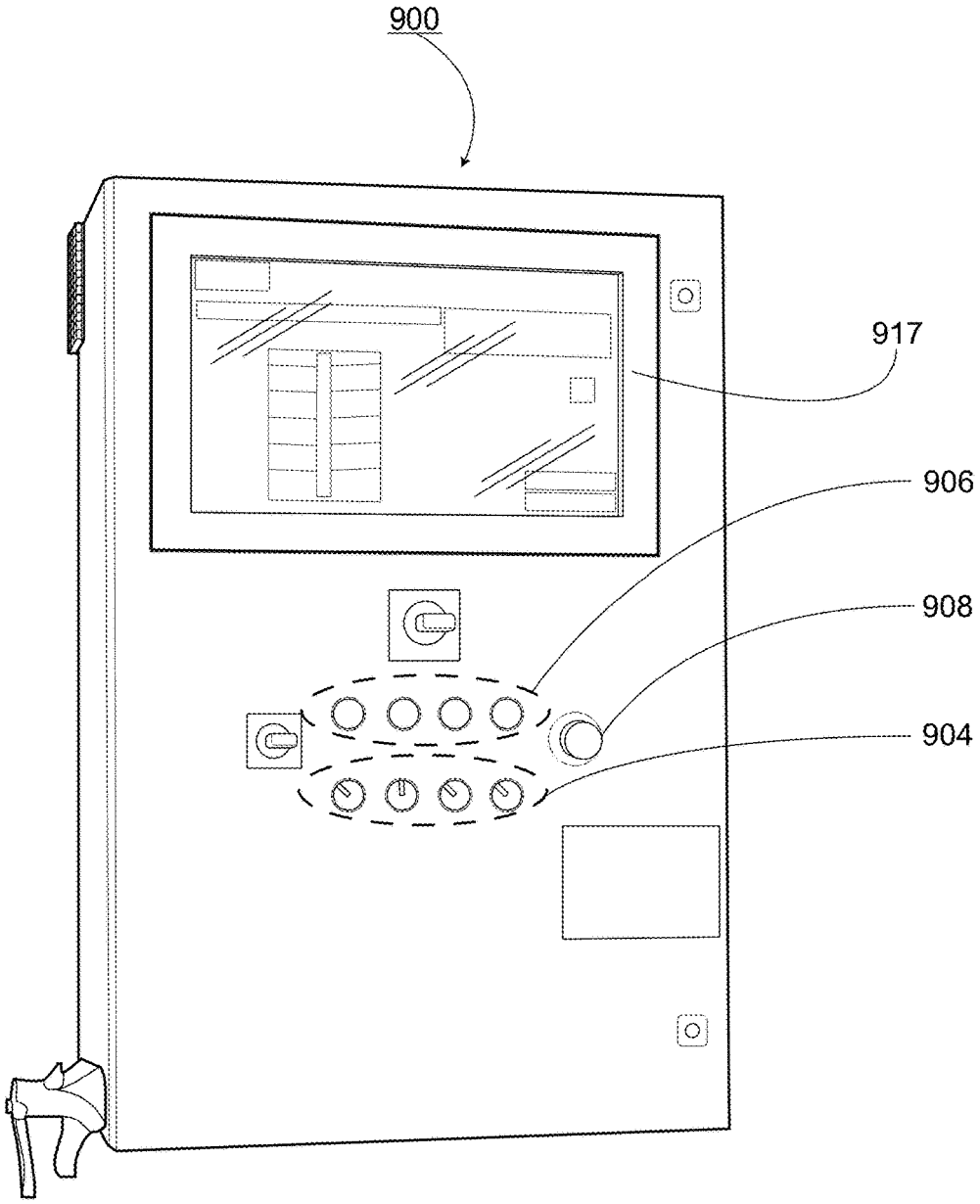

The central control system 116 may be provided in a control console 900. FIGS. 9A and 9B illustrate exemplary control consoles 900, according to various embodiments of the present disclosure. In various embodiments, the control console 900 houses the central control system 116 and includes a user-interface 917, for example, in the form of an IPC touchscreen display. The control console 900 includes a controller as detailed above and is configured to provide the operator detailed system information and further configured to receive operator input in response thereto, as hereinafter described. As illustrated, the controllable user-interface 917 includes a touch screen display through which an operator may input commands to control the creel system 100 and watch (monitor) system performance as the creel system 100 may display any number of status alerts or notifications on the touch screen display. Here, the user interface 917 includes a touch screen display that includes a plurality of inputs 904 that an operator may manipulate, for example, to change the information displayed on the touch screen display. In some embodiments, the console 900 may further include a plurality of LED indicators 906 that, for example, may correspond to the inputs 904 and provide indication as to which input 904 is selected. An emergency stop 908 may also be provided.

Thus, the creel system 100 is controllable via the central control system 116 integrated into the control console 900. The control console 900 may transmit information to and receive information from the the various creel sub-systems and/or devices described herein. With information received from these monitoring systems (or any of them), text or graphics depicting the wire condition (i.e., whether broken), wire tension, and/or environmental conditions in the creel room may be provided to the operator in real-time on the display 917. The control console 900 may also include (or be connected to) other displays or inputs (not illustrated). For example, where a creel system 100 is installed in a creel room of a facility, one or more other computers may be connected to the user-interface via a LAN network or other means to provide additional users the ability to monitor and/or control the creel system 100.

FIG. 9B illustrates an alternate version of the control console 900, according to one or more alternate embodiments. Here, the control console 900 is divided into separate sides 920, 922. The left side 920 includes an IPC 924, a remote access control key 926, a foldable shelf 928, a keyboard and/or mouse access point (connector) 930, and an emergency stop 932. Here, the left side 920 includes a left door 934 that may be opened via door access latch 936. The IPC 924 is programmable to include software for implementing one or more aspects of the central control system 116 described herein.

FIG. 9C illustrates a close up of the right side 922 of the control console 900 of FIG. 9B. As shown the right side 922 may include a right door 938 that may be opened via latch 936. In addition, a power disconnect 940 and a sensor 942 for measuring temperature and/or humidity may be provided on the right side 922 of the control console 900. Also, a plurality of buttons, indicators, and/or switches may be provided to control or operate the system or sensor systems in the event that the HMI display should fail. It should be appreciated that this would allow the user to continue to operate the system in the event of a screen failure.

The control system 116 may include a software platform that displays live measurements of the creel system 100 on the touch screen display 917 or IPC 924 and permits the operator to control operation thereof in real-time. FIGS. 10A-10I are screenshots of the touch screen display 917 or IPC 924 and illustrate various aspects of the platform, according to one or more embodiments of the present disclosure. However, it should be appreciated that the software platform is fully customizable and modified for an end user's particular application, and that the following screen shots are just one exemplary embodiment of the software platform. Thus, the software platform may comprise any number of other screen shots and/or functions without departing from the present disclosure.

Figure 10A:
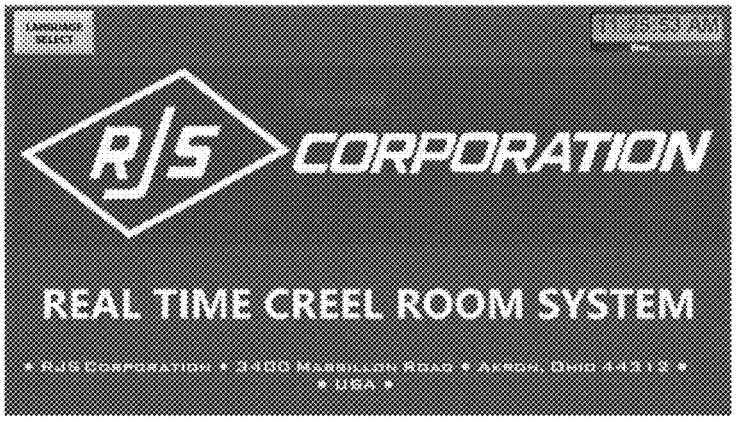
FIGS. 10A-10N are screen-shots of the touch screen display of FIG. 9 that illustrate various aspects of a software platform that may be utilized to monitor and control the creel system.
Figure 10B:
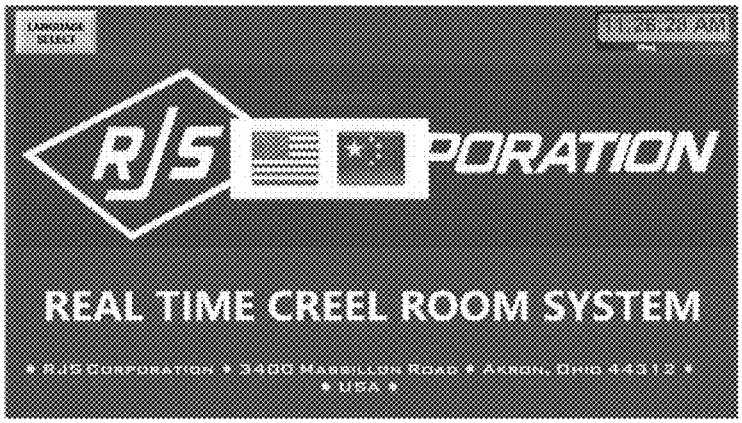

FIG. 10A illustrates an introduction screen 1002 of the platform, according to one or more embodiments of the present disclosure. Here, the platform includes language translation capabilities so that the user may select which language is displayed on the touch screen display 917, and FIG. 10B illustrates a translation selection screen 1004 of the platform, according to one or more embodiments of the present disclosure. In some embodiments, selection of the language will also change the units in which the measurements are displayed. For example, if an operator selects German translation, the units may be displayed in SI units, whereas if an operator selects English translation, the units may be displayed in either US customary units (e.g., for US users) or SI units (e.g., for British users).

Figure 10C:
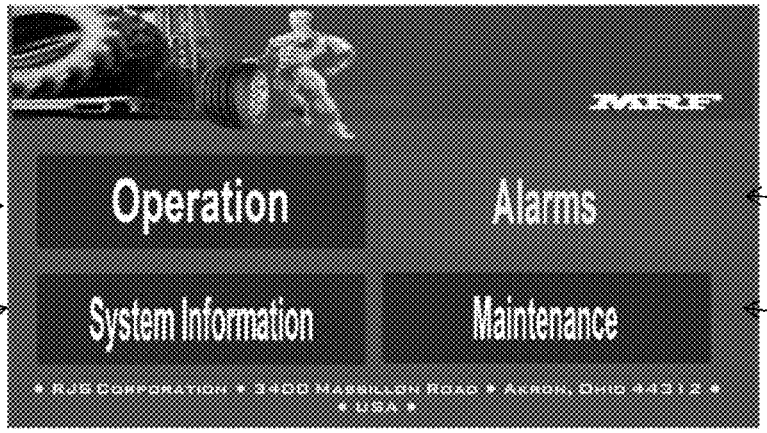

FIG. 10C illustrates a system function selection screen 1006 of the platform, according to one or more embodiments of the present disclosure. Here, the logo of the operator's company may be displayed on the screen, and the operator may select the particular functionality that he/she would like to access. For example, the function selection screen 1006 may include various function selections for the operator, such as an operation screen selection button 1008*a*, an alarm screen selection button 1008*b*, a system information screen selection button 1008*c*, and/or a maintenance screen selection button 1008*d*. This screen 1006 may also include a selection to take the operator back to the home screen 1002.

Figure 10D:
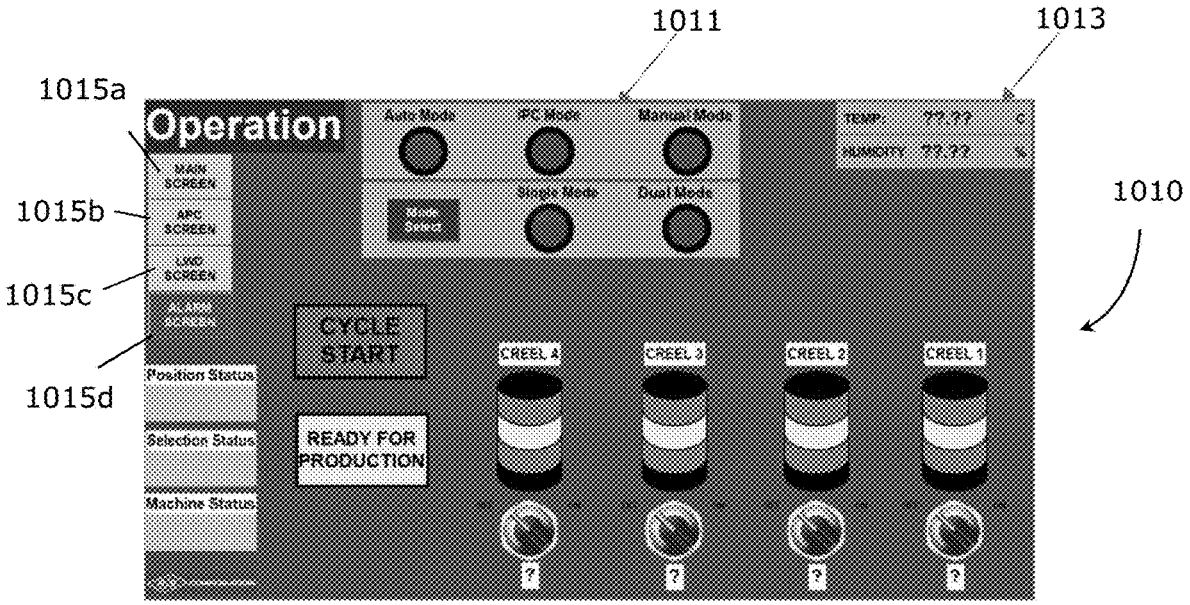

FIG. 10D illustrates an operation screen 1010 according to one or more embodiments of the present disclosure. The operation screen 1010 may be accessible by pressing the operation screen selection button 1008*a*. The operation screen 1010 may be the main production screen, and include various indicators and/or selections, such as Mode of Operation indicator 1011, temperature and/or humidity indicators 1013, selected creels indicators (i.e., on or off) and which may be displayed to mirror creel light stacks, position status (i.e., whether the creel position is valid or invalid), selection status (i.e., whether the creel row selection is valid or invalid), machine status (i.e., whether the machine is ready or not ready), etc. This configuration may allow selection of a single creel run position, may allow for starting of automatic shift cycle, and may also include a "ready for production" push button to signal to the calender that the creel is ready for production. Also, a home button 1015*a* may be located on the operation screen 1010 to allow the operator to return to the home screen. Also, operation screen 1010 may include selections to allow migration and navigation between screens on the system, for example, an APC Screen button 1015*b*, an LWD Screen button 1015*c*, and an Alarm Screen button 1015*d*.

Figure 10E:
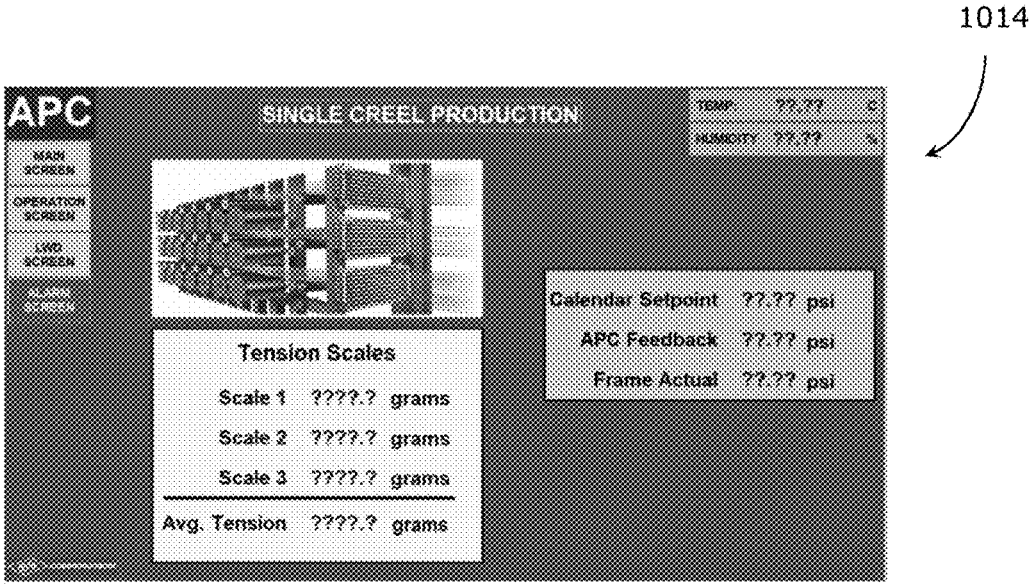
Figure 10F:
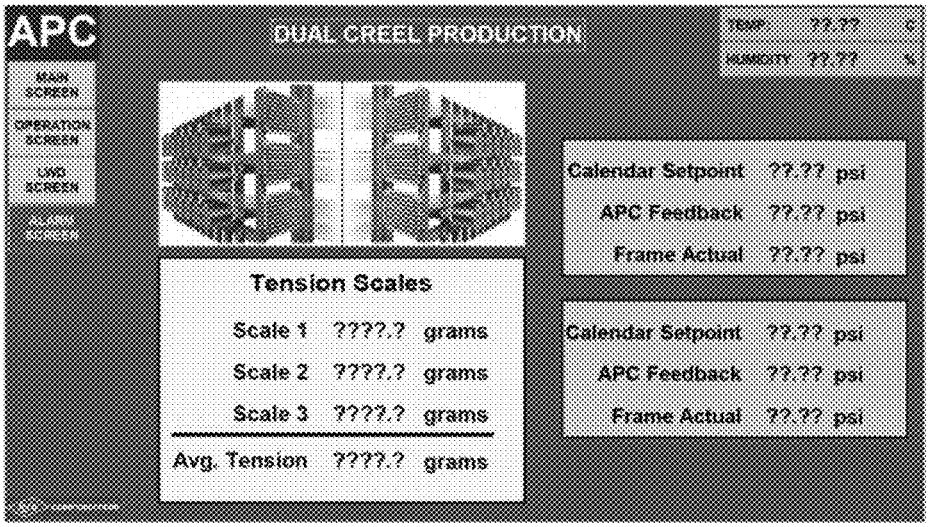

FIGS. 10E-10F illustrate a single creel operation or production screen 1014 and a dual creel operation or production screen 1016, respectively, according to one or more embodiments of the present disclosure. These screens display temperature and humidity data. With regard to the single creel operation or production screen 1014, APC activity is displayed, for example, calender set-point pressure in psi, APC solenoid valve pressure set-point feedback on selected creel in psi, selected creel frame actual pressure in psi. With regard to the dual creel operation or production screen 1016, calender pressure set point in psi may be received from calender via a network connection, and information displayed on the screen 1016. Also, APC solenoid valve pressure set feedback pressure for selected creel(s) is received from the APC (and generated by the pressure transducer located on the APC), and pressure feedback to the servo air valves can be compared against the value sent from the calender. In addition, actual pressure of the selected creel frame(s) may be monitored, as such data is transmitted back to the PLC to show any differences from setpoint, feedback, and the actual frame. Both the single and dual creel operation or production screens 1014, 1016 may also provide for monitoring of the tension monitoring stand 800, for example, display of the tension readings from sensors 802, and the screen 1014 may display an average tension of the wires selected at a tension monitoring stand 800, and may provide navigational buttons for migrating between screens, such as function screens and the home screen.

Figure 10G:
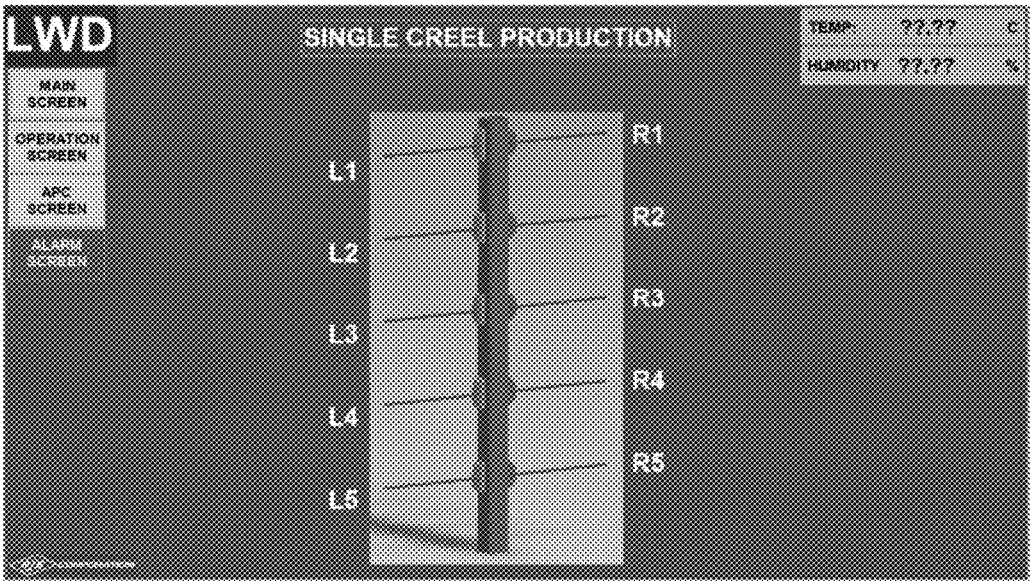
Figure 10H:
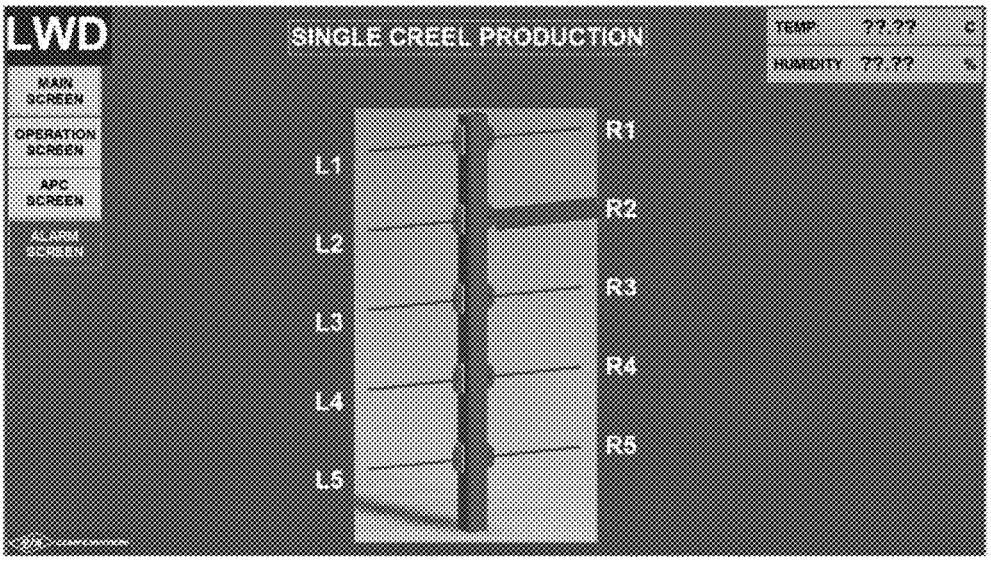
Figure 10I:
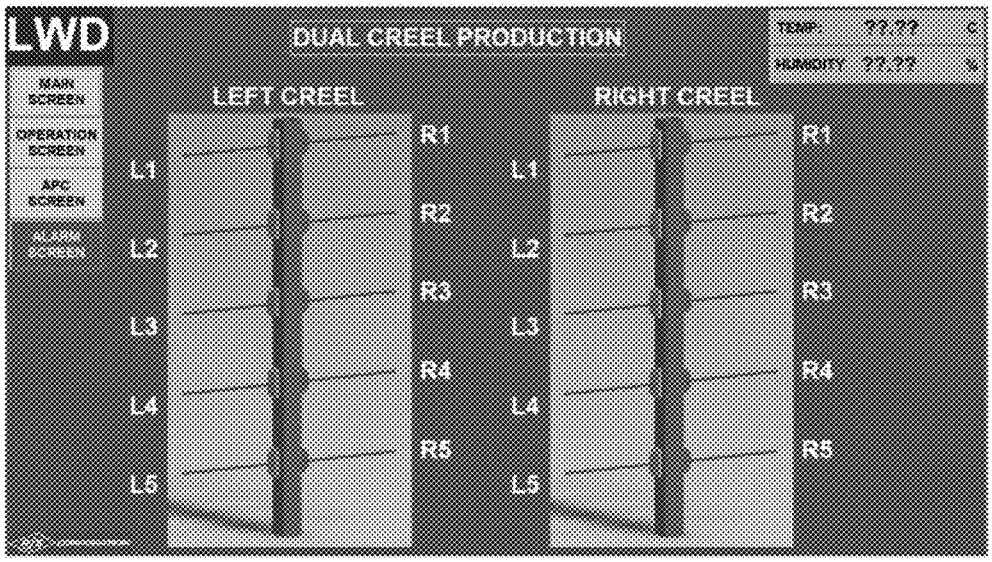
Figure 10J:
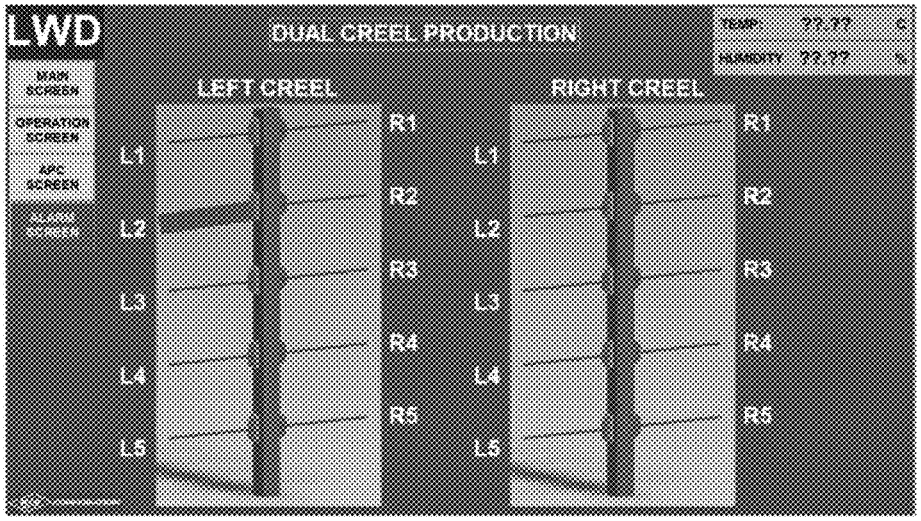

FIGS. 10G-10J illustrate various LWD associated screens 1018, 1020, according to one or more embodiments of the present disclosure. In particular, FIGS. 10G and 10H illustrate representation of the LWD system during a single creel operation, whereas FIGS. 10I and 10J illustrate representation of the LWD system during a dual creel operation. These screens depict a wire tree with conductive sensors, and may indicate present of a loose or broken wire by highlighting the particular conductive rod that was tripped or that sensed a loose or broken wire. For example, FIGS. 10G and 10I include a graphical representation of a wire tree with conductive rods when unactivated (i.e., not an alarm state), whereas FIGS. 10H and 10J include a graphical representation of the wire tree with a conductive rod when activated (i.e., in an alarm state). In FIG. 10H, the screen displays that conductive rod R2 has been activated/tripped, where conductive rod R2 corresponds with the actual conductive rod located on the right side and second row from the top of the wire tree; however, nomenclature may be differently provided, for example, such that R1 corresponds to the bottom most right-hand side, and R5 corresponding to the upper most right-hand side. This way, the operator may readily determine that a broken or loose wire is present in the operating creel at wire row right 2. In FIG. 10J, the screen displays that conductive rod L2 has been activated/tripped in the left creel, where conductive rod L2 corresponds with the actual conductive rod located on the left side and second row from the top of the wire tree of the left creel. This way, the operator may readily determine that a broken or loose wire has been detected in the left creel at left wire row 2.

Figure 10K:
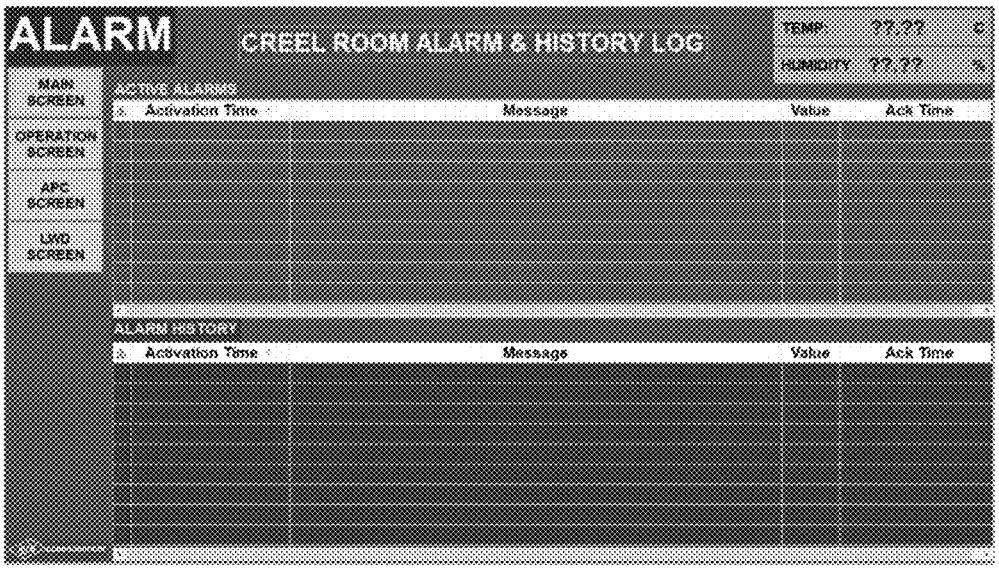

FIG. 10K illustrates an alarm and history log screen 1022, according to one or more embodiments of the present disclosure. The alarm and history log screen 1022 is accessible via the alarm screen button 1015*d* on any of the preceding screens. The alarm and history log screen 1022 includes a log of active alarms and a log of alarm history, and either or both log may track various statistics associated with each event, including but not limited to date, time, description, associated system, status, and action taken, etc. The screens may be customizable and may log additional data. For example, the operator may customize the either/both logs to list all or only list certain events that require immediate corrective action, and/or to allow for color coding of different events based on their status (e.g., events that have not yet been fixed may be highlighted in red, whereas events that are fixed are green and events that have been checked and/or under examination are yellow). Also, the operator may assign an event to one of his or her colleagues such that said colleague receives notification of the alert (e.g., on his or her mobile device with mobile application as hereinafter described) and may then take corrective action while the operator monitors the status of the event while his or her colleague addresses the same. The logged data and information may be exported to various different devices, including via USB download or other wireless transmission. The alarm and history log screen 1022 exemplified in FIG. 10K doesn't include any logged events. FIG. 10L is a listing of example alarm messages that may be populated within the logs on the screen 1022. Also, the alarm and history log screen 1022 may provide navigational buttons for migrating between screens, such as function screens and the home screen.

FIG. 10M illustrates a maintenance screen 1024 according to one or more embodiments of the present disclosure. The maintenance screen 1024 may be accessible by pressing the maintenance screen selection button 1008*d*. The maintenance screen 1024 may provide temperature and humidity readings (or other environmental info) in real time, and also provide access to information that may be helpful to maintain and/or operate the system. For example, the operator may access electrical schematics of the various equipment, which he/or she may export to another device or printer for later use. Also, the operator may access the handbook, FAQ and/or other warranty info. In some embodiments, the operator can communicate with maintenance personnel via the software, for example, the operator could schedule a maintenance appointment via functionality accessible on the maintenance screen 1024. Also, the maintenance screen 1024 may provide navigational buttons for migrating between screens, such as function screens and the home screen.

Figure 10N:
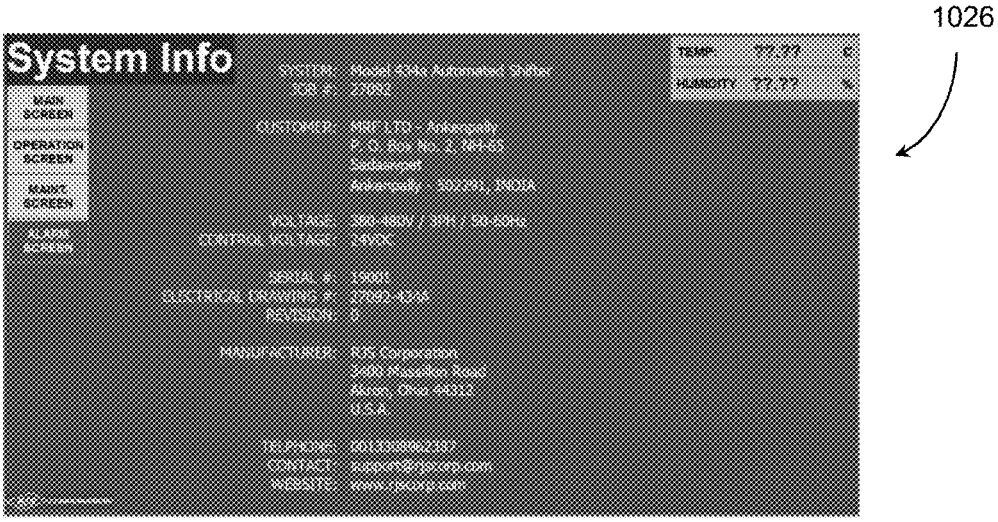

FIG. 10N illustrates a System Info screen 1026 according to one or more embodiments of the present disclosure. The System Info screen 1026 may be accessible by pressing the system info selection button 1008c. Also, System Info screen 1026 may provide information and details about the particular creel system and equipment utilized therewith, and may include navigational buttons for migrating between screens, such as function screens and the home screen.

Control of the creel system 100, however, may also be implemented using remote devices, including through use of creel system control and/or visualization applications installed on computers, laptops, or mobile devices, etc. For example, a mobile device or smart phone "app" may be installed to communicate with the control system 116. In this example, such mobile device could communicate with the central control system 116 to provide remote monitoring of various creel systems, functions, devices, in a similar manner as described with the control console 900, such that the operator may remotely monitor operation parameters and/or environmental parameters of the creel operation. Such communication between the remote device and the control system 116 (or control console 900) may occur via various wireless or wired communication means, for example, wirelessly through BlueTooth™ or WiFi™, wirelessly through the Internet where the controller of the control system 116 (or control console 900) is internet-enabled, via a hard hardwire (e.g., USB cable, Ethernet cable (e.g., CAT6 cable), etc.), or combinations thereof. The app may transmit information to and receive information from control system 116, or may directly transmit information to and receive information from one or more systems, sensors, or devices of creel system, such as the LWD system and/or the environmental monitoring system.

In alternative or complementary embodiments, the app may include the same operator input options as provided on control system 116 to provide control commands to the controller (of the controllable user-interface 917) to manually or automatically effect tensioning of the wire W and/or monitor (and/or adjust) environmental conditions of the creel room. In further alternative or complementary embodiments, security features may be provided through or built into the app. For example, the phone can implement a security control (e.g., password, PIN, code, pattern, biometric scan, and others) that may prevent total access to the platform, allow monitoring but prevent remote control, transmitting or receiving data to or from the app, or other activity related to creel system (e.g., changing environmental conditions in the creel room) based upon permission granted through successful passing of the security control.

Figure 11:
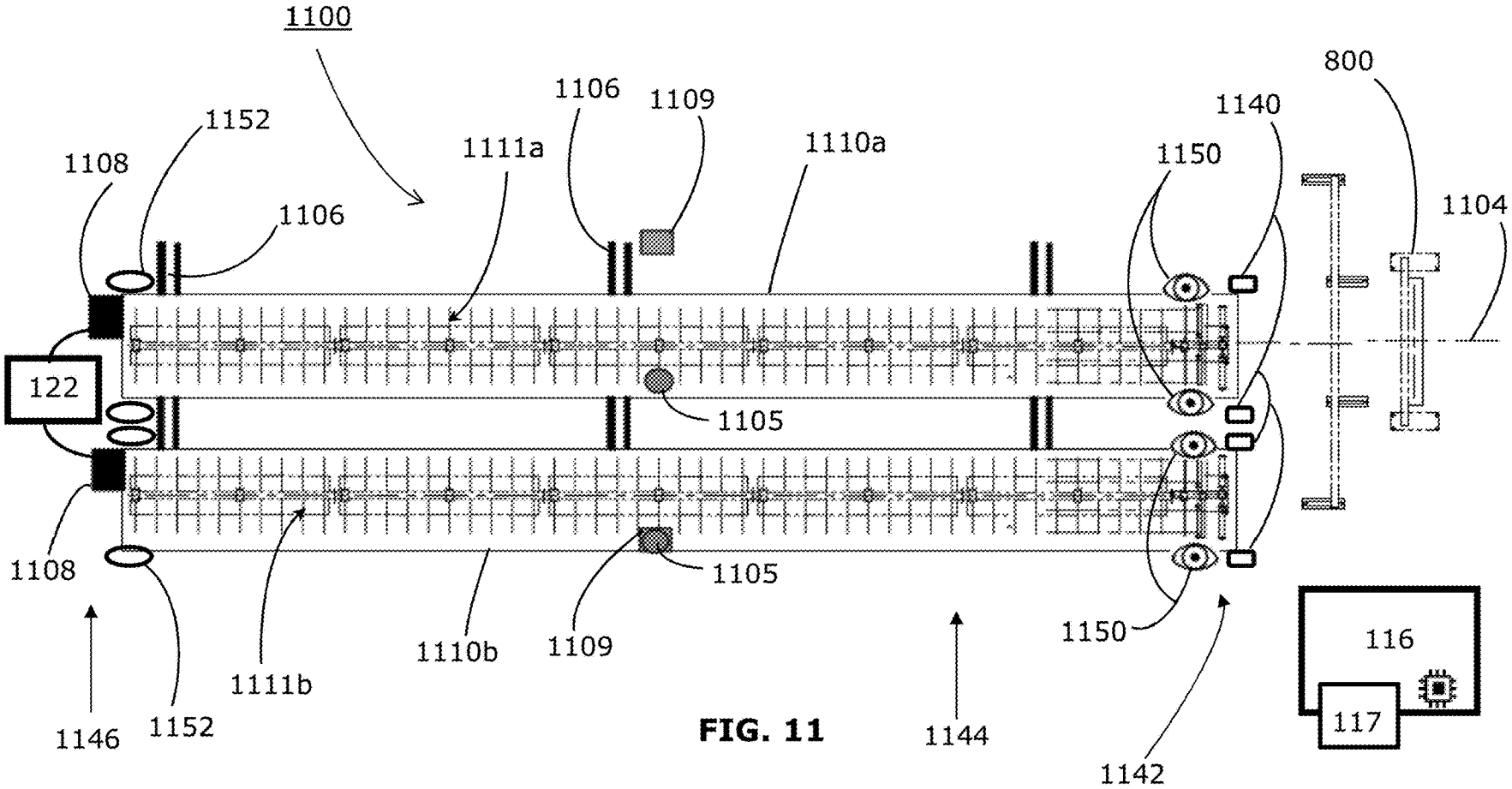
FIG. 11 is a plan view of a creel system having multiple creel rows in accordance with the present disclosure.

FIG. 11 illustrates aspects of the shifting platform control (SPC) 122 when implemented on a multi-row creel system 1100, according to one or more embodiments of the present disclosure. While the multi-row creel system 1100 may be similar in some aspects to the creel system 100, 700 discussed above, the creel system 1100 is provided on shifting platforms 1110a, 1110b and includes SPC 122. In this type of creel system 1100, individual creel rows 1111a, 1111b (generally, 1111), each having its own creel frame 102 (and each comprising one or more frame segments F), a front organizing stand (FOS) 104, and a main organizing stand (MOS) 106 are mounted to steel platforms 1110a, 1110b with each such platform P carrying an individual creel row 1111. The platforms 1110a, 1110b may include a motor 1108 configured to drive wheels (not illustrated) which ride along rails 1106 embedded on the creel room floor. The motors 1108 may be controlled at a main enclosure of the system which may include, for example, an emergency stop button and push buttons for each row to control right and left shift. The main enclosure may be located in the creel room along with other system controls. In other embodiments, each row may have its own control panel mounted directly to the shifting row. With multiple creel rows 1111a, 1111b in one system 1100, one row 1111a can be positioned on the calender centerline 1104 while running (in a "run position"), and the other row 1111b can be positioned off to the side (in a "loading position"). In other embodiments, 2 rows may be positioned symmetrically about the calender centerline such that both may run together. In this way, the second row 1111b is out of the way of the calender centerline 1104 and can be loaded with spools. When the first row 1111a completes its run, it may then be moved to the side, for example, on the embedded rails 1106 wherein the second row 1111b takes its place along the calender centerline 1104. This minimizes calender downtime between runs. The rows 1111a, 1111b can be switched again when the second row 1111b is finished.

The central control system 116 and the motors 1108 may communicate with each other. This allows an operator manipulating the user interface 117, 917, to move each creel row 1111a, 1111b to a desired position on the creel room floor. In some embodiments, the creel rows 1111a, 1111b are configured to move in series to its new target position. While two creel rows 1111a, 1111b are illustrated, it is to be appreciated that the number of creel rows 1111 is non-limiting. The central control system 116 provides the ability to automatically move all the rows to a desired position based on a single specified operator input, as compared to controlling the platforms using press-buttons in a main enclosure. As a further example, FIG. 12 illustrates a creel room with eleven creel row positions 1111.

In some embodiments, each platform 1110a, 1110b, includes at least one proximity sensor 1105 which is configured to detect features 1109 on the creel room floor G. The features 1109 may be in the form of a pad in the floor. In other embodiments, the proximity sensor is replaced with an RFID reader which senses RFID tags mounted to the floor, for example, as illustrated in FIGS. 15A-15C. In even other embodiments, mechanical limit switches may be used to determine position. This allows each platform 1110a, 1110b to shift until it reaches the detectable feature 1109. For example, the detectable features 1109 may be pads that are detectable by the proximity sensor(s) 1105 and located at the loading and running positions for that creel row. In some examples, limit switches may be utilized to prevent overtravel of the platforms 1110, for example, the outer platforms.

Figure 12:
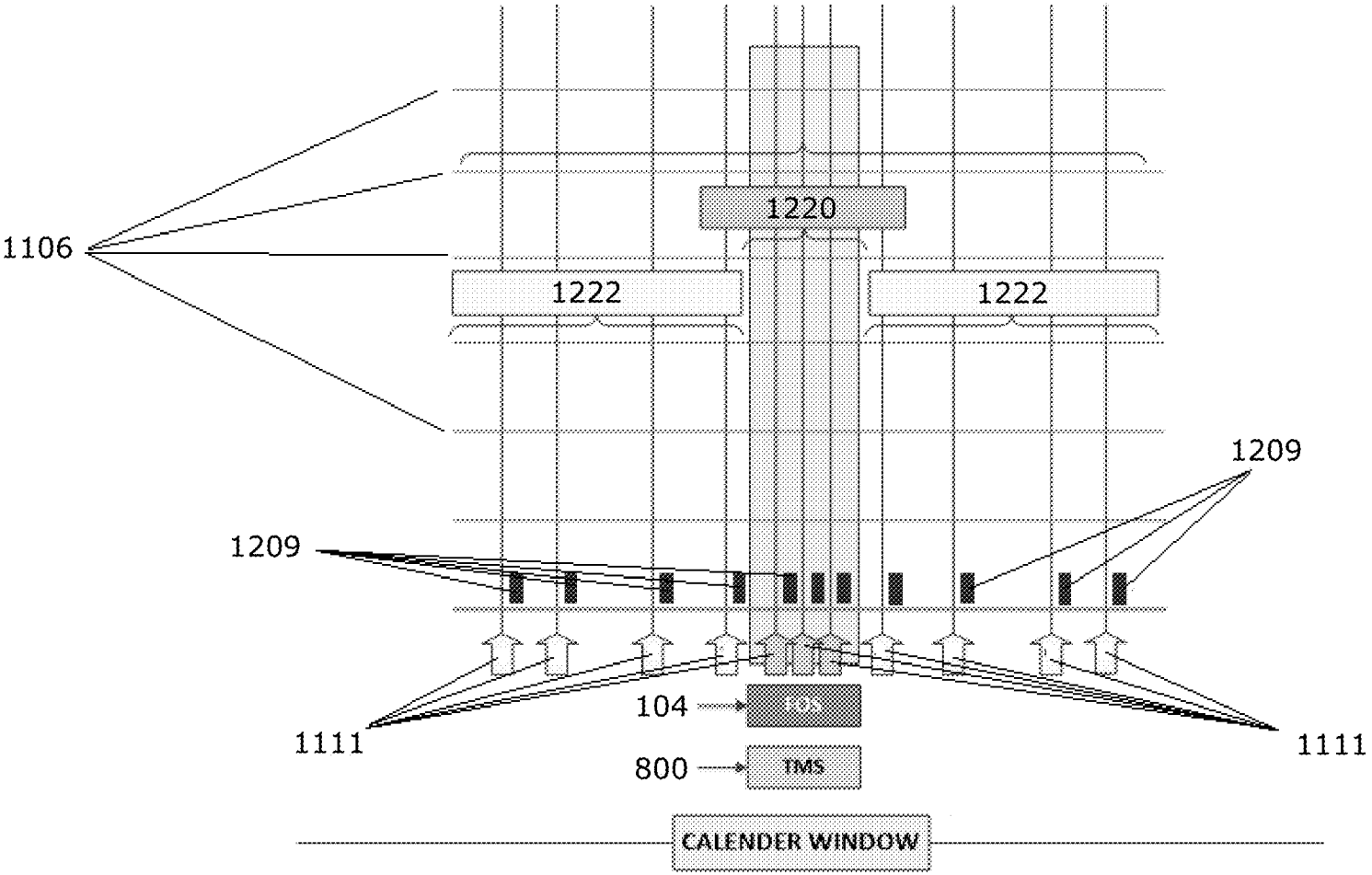
FIG. 12 is a diagram of multiple creel rows in a creel room in accordance with the present disclosure.

In some embodiments and with reference to FIG. 12, creel row 1111 position is assisted by placement of encoded proximity plates 1209 at predetermined locations in the creel room. That is, the feature 1109 on the creel room floor is embodied as a proximity plate 1209. In some embodiments, the plates 1209 are constructed of 0.5 inch nylon with a plurality of machined pockets each configured to received a pad (e.g., a steel or nylon pad) secured to the pocket with fasteners, adhesive, or the like. The plates 1209 are affixed to the creel room floor G, for examples, with screws after the plate position is verified. As compared to designs implementing embedded plates, this design allows for later adjustment of creel row positions. In other embodiments, the proximity sensor is replaced with an RFID reader which senses RFID tags mounted to the floor. In even other embodiments, mechanical limit switches may be used to determine position.

FIG. 12 illustrates the general layout of proximately plates 1209 in a creel room. Each plate 1209 is encoded by placing either a nylon or metal pad in each of the pockets, described in greater detail below. When the plates 1209 are positioned correctly beneath proximity sensors 1105, the proximity sensors 1105 are able to read the encoding of the of the plate 1209. As illustrated in FIG. 12, multiple plates 1209 having a unique encoding (i.e., position of metal and nylon pads on the plate 1209) are secured to the floor near the FOS 104. Each creel row 1111 rides on rails 1106 to a desired position in relation to the plates 1209. The plates 1209 may be positioned such that multiple zones are defined in the creel room. That is, plates 1209 may be positioned in front of the FOS 104 defining a run zone 1220. Plates may also be positioned away from the FOS 104, for example, on opposing sides thereof, defining an exclusion/loading zone 1222. In other embodiments, the proximity sensor is replaced with an RFID reader which senses RFID tags mounted to the floor. In even other embodiments, mechanical limit switches may be used to determine position.

The central control system 116 may utilize the plates 1209 to determine where each creel row 1111 is located before automatic functions will execute. The creel rows 1111 not in the run zone 1220, i.e., the creel row(s) 1111 located in the excluded/loading zone 1222, may be ignored by the central control system 116 for alarm purposes. In other embodiments, the proximity sensor is replaced with an RFID reader which senses RFID tags mounted to the floor. In even other embodiments, mechanical limit switches may be used to determine position.

FIG. 13A illustrates and exemplary plate 1209 for secured attachment to the floor, according to one or more embodiments of the present disclosure. The plates 1209 are configured to be detected by proximity plate detectors to thereby provide location of creel rows 1111 which may be utilizable for automatic functions. The plate 1209 includes a substantially planar body 1302 having a thickness that allows for a plurality of pockets 1304 serially aligned along the planar body. Each pocket 1304 is configured to receive either a metal or non-metal complementary shaped pad (1305, 1306, respectively). The order and number of metal pads 1305 and non-metal pads 1306 in the pockets 1304 provides a binary coding that is able to be read by proximity sensors 1105 located on the platform 1110. In the illustrated embodiment of FIG. 13A, the body 1302 includes a total of six pockets 1304 configured to receive a metal pad 1305 or non-metal pad 1306. In some embodiments, the metal pad 1305 is a steel pad. In some embodiments, the non-metal pad 1306 is a nylon pad. While 6 pockets are illustrated it is to be appreciated that the number of pockets is not limiting and that a body may include more or less than 6 pockets. Furthermore, while the pockets 1304 and inserted pads 1305, 1306 are illustrated in a spaced apart serial alignment, the serial position is not limiting. That is, any arrangement of pads, e.g., in a circle pattern, block pattern, etc. that can be read by a corresponding proximity sensor 1105 may be used without departing from the scope of the present disclosure. In some embodiments, the plates 1209 may be installed or positioned inside the first or front rail 1106. In other embodiments, the proximity sensor is replaced with an RFID reader which senses RFID tags mounted to the floor. In even other embodiments, mechanical limit switches may be used to determine position.

FIG. 13B illustrates a proximity pad detector unit 1320, according to one or more embodiments of the present disclosure. The proximity pad detector unit 1320 includes a frame 1322 and at least one sensor or detector 1324 supported by the frame 1322. The frame 1322 may be connected to the creel row 1111 such that it moves with the creel row 1111 and provides indication when moved over the detection plates 1209 and thereby provides indication as to the location of the creel row 1111 based on which detection plate(s) 1209 is read. In some embodiments, the detector 1324 includes a plurality of individual detector indicators 1326 (e.g., LEDs) that, when energized will provide indication (e.g., be energized or glow). In some examples, the detector indicators 1326 corresponding with the steel inserts 1305 in the plate 1209 would be activated/energized, whereas the detector indicators 1326 associated with the non-metal inserts 1306 would not be energized. In the illustrated example of FIGS. 13A and 13B, the plate 1209 includes six pockets 1304 for six inserts, with the first pocket and fifth pocket each being provided with a metal insert 1306*a*, 1306*e*, respectively, and the detector 1324 includes six individual detector indicators 1326 that each correspond with one of the pockets 1304 on the plate 1209, with the first detector indicator 1326*a* being activated/energized when oriented over the first metal insert 1306*a* and the fifth detector indicator 1326*e* being activated/energized when oriented over the fifth metal insert 1306*a*. In some examples, one or more of the plates 1209 may be provided to include metal inserts 1305 in all of its pockets 1304 to confirm functionality of the detectors 1326, for example, when the creel rows 1111 are moved individually into a center row location. The proximity pad detector units 1320 may be in communication with the central control system 116, such that the central control system 116 may access data from the detectors 1324 to thereby determine positions of the creel rows 1111. In other embodiments, the proximity sensor is replaced with an RFID reader which senses RFID tags mounted to the floor. In even other embodiments, mechanical limit switches may be used to determine position.

FIGS. 15A-15C illustrate an alternate system 1500 for sensing position of the shifting creel rows, according to one or more alternate embodiments. The sensing system 1500 may include one or more RFID tag readers 1502 configured to identify/sense RFID tags 1504 mounted to the floor. Each creel row may include at least one of the readers 1502. The RFID tags 1504 may be retained on the floor via a plate 1506. While the sensing system 1500 may be utilized in lieu of the system of FIGS. 13A-13B, in some examples, the sensing system 1500 may be utilized in combination with the system of FIGS. 13A-13B. For example, some creel rows may include the system of FIGS. 13A-13B, whereas other creel rows may include the the sensing system 1500 of FIGS. 15A-15C; and/or at least some creel rows may include both the system of FIGS. 13A-13B and the sensing system 1500.

Creel systems described herein may also include one or more safety features or devices. Such safety features and/or devices may be controlled by the control system 116. That is, several devices within the creel system 100, 1100 generate information to enhance the safety of system operation. Safety features and devices may include, for example, safety rope pull switches, collision detection and avoidance systems, and platform drive photo eyes for variable frequency drive movement interrupt.

Regarding the safety rope emergency switches (SRES) and with reference back to FIG. 11, pull switches 1140 may be provided to stop operation of the creel system 1100 and/or to send a signal to shut down production. The pull switches 1140 may be mounted along the sides of the creel rows 1111. The switches 1140 may be mounted or fixed to the frame 102 (or a frame segment F thereof), for example, at a front end 1142 of each creel row 1111. In other embodiments, the switches 1140 may be mounted to the frame of the FOS. A rope (not illustrated) may be connected to each pull switch 1140 for activating or engaging the pull switch 1140. The ropes may be routed from their associated pull switch 1140 along the creel row 1111, for example, along a long side 1144 of the creel row 1111*b* towards a rear end 146 of the creel row 1111*b*. The rope may be positioned at various locations about the frame 102, for example, where it is user accessible and, in one example, the rope is positioned at the level of the third row of tension controllers 202. However, the position and length of the rope is adjustable, and may be routed into various positions as may be desirable in a particular end use application. The switch 1140 is designed to send a SRES signal when the rope is pulled, which signal may be used by the calender operator to shut down production in case of emergency. The pull switches 1140 may be in electronic communication with the central control system 116 and, in some embodiments, the safety SRES signals from the pull switches 1140 are routed to the central control system 116 and thereby made available at a data address for the calender to read at any time. For example, the pull switches 1140 may be connected to the central control system 116 such that, when the rope is pulled, a warning light on the user interface 117, 917 may become illuminated and/or some other indication may be generated thereon, with the SRES signal being appropriately addressed for the calender to read or retrieve at any time. Thus, the generated SRES signals may be addressed for the calender to read at any time, and this information may be consolidated with other data desired by the calender without need for additional wiring. In some embodiments, some of the pull switches 1140 are activate and some are inactive. For example, during a production run, the creel system 1100 may scan only the operating creel row 1111*a* in the calender centerline 1104 for the rope switch 1140 activation, while the safety ropes and pull switches 1140 in inactive creel rows (e.g., creel row 1111*b*) are not monitored, thereby allowing the loading/unloading/maintenance of such inactive creel rows without interrupting the production run in the event that the switch 1140 be tripped.

In some embodiments, the creel system 1100 includes a collision-avoidance system (CAS) for detecting neighboring creel rows 1111 and preventing collisions during movement operations involving any of the creel rows 1111. The CAS comprises collision-avoidance photo eyes 1150 for detecting neighboring creel rows 1111. The eyes 1150 may be positioned on the frame 102, for example, at lower outwardly extending portions of the frame 102, with two photo eyes for each creel row 1111*a*, 1111*b*, each creel row 1111 having a first eye 1150 for monitoring the left directional movement of the associated creel row 1111 and a second eye 1150 for monitoring the right directional movement of the associated creel row 1111. The eyes 1150 may be in communication with the central control system 116. Communication between the photo eyes 1150 and the central control system 116 may be achieved wirelessly and/or via wired connection. The collision-avoidance photo eyes 1150 prevent creel rows 1111*a*, 1111*b* from colliding into each other during any motor driven event.

The CAS system is usable to detect the creel row 1111*b* next to the moving creel row 1111*a* and, upon detection of the neighboring creel row 1111*b*, affect driving of the moving row 1111*a*. For example, the CAS may be configured to transmit a stop signal that disables the drive command in that direction but does not affect drive function in the opposite direction, and in such examples, any disabled drive command or drive functionality may be reset or restored when the moving creel row 1111*a* has moved to a position where the neighboring creel row 1111*b* is no longer within the detection range or zone of the collision-avoidance photo eyes 1150. In some examples, the CAS may be configured to transmit a stop signal that disables the drive command in that direction and then transmit a go command to automatically enable drive function in the opposite direction. The CAS system may be activated by movement (manual, automatic or IPC mode) of a creel row 1111*a*, 1111*b*, such that the CAS is in an inactive or sleep mode until it is activated or awakened by movement.

In some embodiments, the photo eyes 1150 may comprise beam type devices mounted about the moving creel row 1111. In some embodiments, the photo eyes 1150 each project a signal or beam (e.g., infrared) to a receiver 1152 at the other end 1146 of the creel row 1111, thereby creating a beam extending along a perimeter of the creel row 1111, for example, along the sides of the creel row 1111. One side will have its transmitter pointed to the rear, while the other side will have its receiver 1152 facing to the rear, whereby mounting them in opposite directions may help avoid any bleed of signal causing a false trip signal. When the beam on either side is interrupted, a corresponding creel frame safety relay is tripped signaling the central control system 116 of a fault and shutting down the drive system and thereby stopping movement. Operational information about the eyes 1150 and any faults may be visually presented on the user interface 117, 917 (e.g., indicators lights, screen alerts or messages, and/or graphics) and/or audibly presented at and/or near the console 900, for example, speakers, sirens, etc. This operational information may be presented to the operator at the control console 900 in a manner indicative of the location at which interruption of the beam was detected to be (e.g., indicator lights associated at a particular row or column of the creel). The system may help prevent personnel from being hit by a moving frame and creel row and to avoid any obstructions on the floor that would impede the movement of the creel row. Also, the system may be activated by movement (manual, automatic or IPC mode) of a creel row 1111*a*, 1111*b*, such that the system is in an inactive or sleep mode until it is activated or awakened by movement. In some examples, when the system has been tripped and the issue causing the trip has been addressed, the drive system may be brought back online by pressing a reset in of the control system 116, for example, in the console 900.

In some embodiments, the central control system 116 is configured to prevent over-travel of the creel rows 1111. For example, the outer side of the first and last platform 1110*a*, 1110*b*, may be equipped with a mechanical travel limit switch configured to prevent over-travel of the platform 1110*a*, 1110*b*, beyond the extent of the rails 1106. For example, when a moving platform actuates a limit switch, the limit switch generates a limit switch signal readable by the central control system for controlling the motion of a moving creel row. These switches may directly disengage the drives of the end of creel rows 1111*a*, 1111*b*, for motion in the outward direction. In some examples, such mechanical limit switch may be reset by manually reversing movement of creel row 1111 at the console 900. In some embodiments, reaching the over-travel limit position may restrict motion to only allow the creel row to travel back away from the end of travel.

In some embodiments, the creel system 100, 1100 includes environmental sensors, including but not limited to temperature and humidity sensors. That is, if present, at least one of an environmental sensor is in electronic communication with the central control system 116. The central control system 116 receives environmental data (temperature data, humidity data, etc.), if the values of the environmental data are beyond a predetermined threshold, the central control system 116 issues an alarm notifying an operator at the user interface 117 of the environmental status. In some embodiments, the environmental data is recorded to the data storage 119. In yet still other embodiments, the environmental data generated by the environmental sensors is made available with a data address for the calender to read at any time.

In some embodiments, the control system 116 is configured to access a cloud network to thereby enable a third party to remotely access the control system 116. In yet other embodiments, the control system 116 is configured to allow point-to-point direct communication with the system manufacturer via internet protocol. For example, manufacturer technicians may utilize this feature to provide support and troubleshoot any issues with the system 100, 1100, remotely. In some examples, this feature allows the manufacturer to connect through a customer network to access the software loaded to the central computer system 116. Access to the system 100, 1100 is controlled by the customer by a key on the physical console 900, so that the manufacturer is only able to access the system 100, 1100 when the customer explicitly turns on access maintaining security on their network. Using the remote access feature, the manufacturer will be able to provide software updates and enhancements as they are developed without requiring physically accessing the machine.

Figure 14:
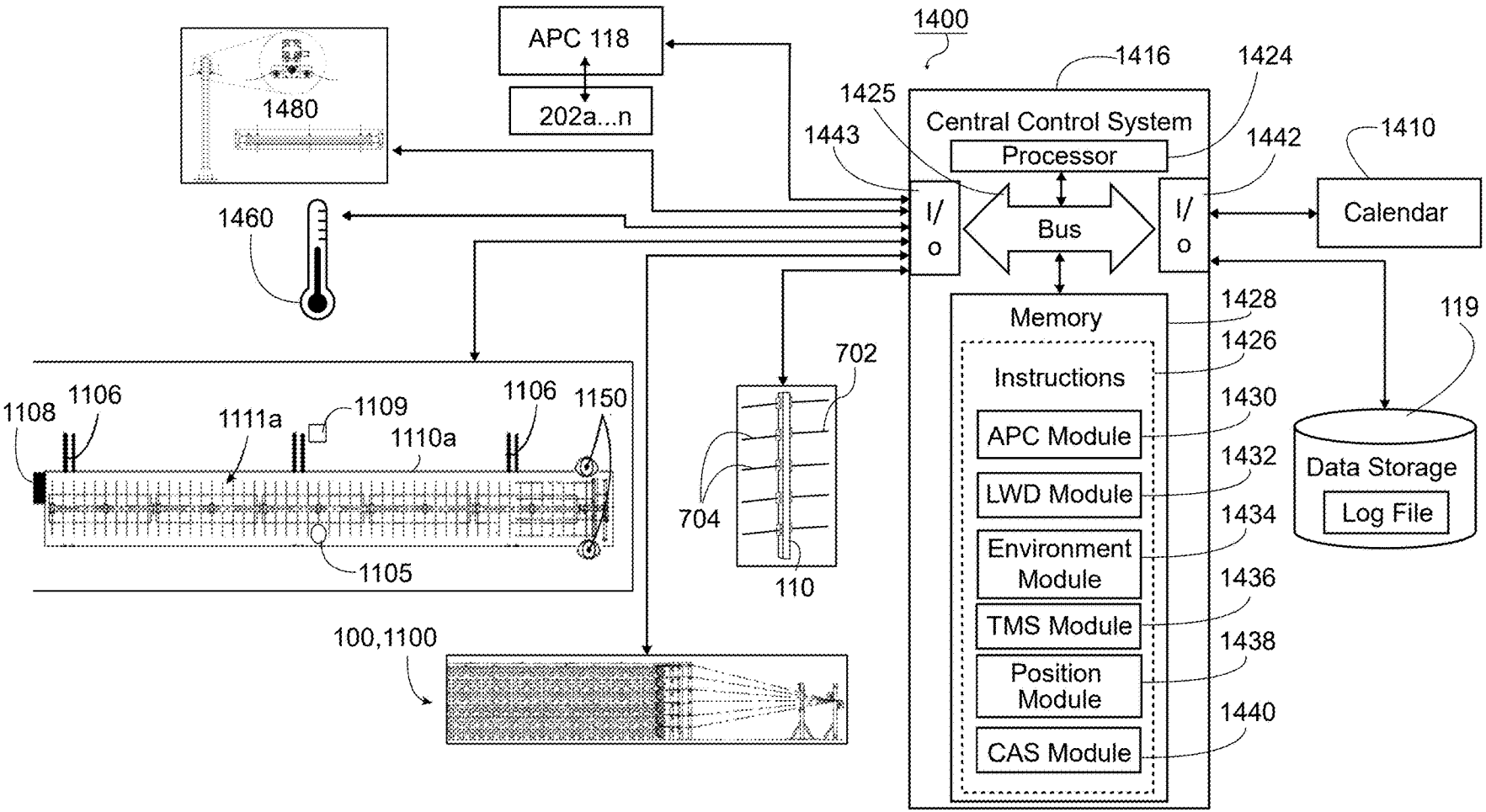
FIG. 14 is an exemplary control system diagram for a creel system in accordance with the present disclosure.

In accordance with another aspect of the present disclosure and with reference to FIG. 14, a digital creel system 1400 for automatic and efficient creel functions is provided. It will be appreciated that the various components depicted in FIG. 14 are for purposes of illustrating aspects of the exemplary embodiment, and that other similar components, implemented via hardware, software, or a combination thereof, are capable of being substituted therein. The system 1400 is configured to control the power or operation of a creel system, e.g., creel system 100, 1100 or similar material handling equipment, based on data received from various sensors and subsystems.

As shown in FIG. 14, the system 1400 includes a central control system represented generally as the central computer system 1416, which is capable of implementing the exemplary method described herein and below. The central computer system 1416 may be variously embodied without delineating from the scope of the present disclosure as an industrial computer, programmable logic controller (PLC), personal computer, tablet, smartphone or other known device that hosts a software platform and/or application. The exemplary computer system 1416 includes a processor 1424, which performs the exemplary method by execution of processing instructions 1426 that are stored in memory 1428 connected to the processor 1424, as well as controlling the overall operation of the computer system 1416.

The control system 1416 may also include a user interface similar to the user interface 117, 917 of central computer system 116 for the monitoring and controlling the various components of the creel system. The control system 1416 is in electronic communication with the sensors and subsystems described in greater detail herein and is configured to receive data (via wired and/or wireless connection) related to or indicative of operation of a creel device 100, 1100 as collected by such sensors and subsystems.

The instructions 1426 include an air pressure control (APC) module 1430 configured to control air pressure via the APC system 118 to tension control apparatuses 202 as each are described above in relation to system 100. In this way, the APC module 1430 can increase or decrease friction applied to the spools 108 by increasing/decreasing air pressure, by controlling various servo valves based on a detected tension of the wires W, and/or signals originating from the calender 1410 in communication with the central control system 1416. In other words, the central control system 1416 receives signals from the calender 1410 to set the target air pressure for at least one tension controller apparatus 202 (or at least one row of tension controllers 202). In some embodiments, the central control system 1416 is also configured to send a signal back to the calender 1410 including the set pressure point received and/or the actual pressure reading from a servo valve of the APC system 118.

The instructions 1426 also include an LWD module 1432 that, when implemented by the processor 1424, controls the power and operation of the LWD system as well as receives data signals therefrom as described above. That is, the LWD module 1432 is configured to determine when the wire W contacts a sensor rod 704, which may be indicative of a wire W being either loose or broken. Upon a determination of a broken or loose wire W, the central control system 1416 may issue an alarm. In some embodiments, this includes graphically displaying a location on a digital representation of the wire tree 110, the area a wire W has contacted, for example, in the IPC user interface 917. The broken/sagging wire indication and location on the wire tree may be recorded to a storage device 119 connected to the system 1416. In some embodiments, the central control system 1416 is configured to send data to the calender 1410 including an indication of a broken or loose wire W along with a relative location of the broken or loose wire W, determined by which sensor rod 704 was actuated by the loose/broken wire W.

The instructions 1426 also include an environment module 1434 that controls the power and operation of the creel system 100, 1100 in response to signals received from environmental sensors 1460, relating to the operating environment of the creel room. In some embodiments, the environmental sensors 1460 include temperature and humidity sensors. When the central control system 1416 receives environmental data beyond a predetermined threshold, e.g., a temperature higher than a threshold temperature, the central control system 1416 issues an alarm. In some embodiments, the environmental alarm includes turning off power to the creel system 100, 1100. In other embodiments, the environmental data and alarm signal is provided to the calender 1410.

The instructions 1426 also include a tension monitoring system (TMS) module 1436 that is configured to receive tension measurements from a tension monitoring system 1480 that may include, for example, the tension monitoring stand 800, described in greater detail above with respect to FIG. 8. That is, the tension measuring sensors 802 of the stand 800 generate a tension output signal that is sent to the central control system 1416. The tension values measured by the tension measuring sensors 802 are made available by the control system 1416 with a data address for the calender to read at any time. The calender logic is able to measure the actual tension output for a specified air pressure input signal. This feedback loop allows either the central control system 1416 or calender to make small adjustments to the air pressure input signal and or the APC 118 based on the measured tension output providing the calender a more precise method of tension control.

In some embodiments, the tension values measured by the tension measuring sensors 802 are displayed on the user interface 117, 917 for monitoring. This screen is available for the creel room operator monitor the tension in the wires W.

The instructions 1426 also include a position module 1438 that is configured to determine the location of creel rows 1111 as well as control the movement of each row. As described above, each row 1111 may be placed on a movable platform 1110. The platform 1110 includes a motor 1108 connected to platform wheels that enable the movement of the creel row 1111 that is secured to the wheeled platform 1110. The movement of the platform 1110 is guided by rails 1106. The creel room floor may also include at least one feature/marker that is read by a proximity sensor 1105 on the platform, allowing the position module 1438 to determine the location of a particular creel row 1111. The central control system 1416 is in electronic communication with the motor 1108 such that upon a movement command from a user, the position module activates the motor 1108 and causes movement of the platform 1110 along the rails 1106 is a desired direction.

In some embodiments, the position module 1438 is configured to process signals obtained from the proximity sensors 1105 mounted to a platform 1110 reading features 1109 or plates 1209 and determine a creel row position for each creel row 1111 within the creel room. The position module is also configured to control the motor 1108 of each platform 1110 and initiate movement of the associated creel row 1111 to a target position. For example, in a 4-row creel system, the current state may be that the first creel row is currently in a middle running position, with the second, third, and fourth creel row positioned in loading positions off to one side (e.g., the left side). Here, if the operator commands the third creel row to move to the run position, the position module 1438 will determine the position of each creel row and instruct the first creel row to move right to a loading position, e.g., the first creel row home position, while leaving room for the second creel row to also move to its loading position secondly; and finally, the third creel row will be instructed to move to its designated run position. In such examples, each movement coordinated by the position module 1438 may occur automatically after the operator specifies the command. Thus, the system 1416 may provide the ability to automatically move all the creel rows to a desired position based on a single specified operator input. In other embodiments, the proximity sensor and plates are replaced by an RFID tag reader and RFID tags mounted to the floor. In still other embodiments, mechanical limit switches may be used instead. In yet still further embodiments, other sensor technology may be used. Various types of sensing technologies may be utilized to determine the position of the creel row without departing from the present disclosure.

The instructions 1426 also include a collision avoidance system (CAS) module 1440 that is configured to prevent creel rows 1111 from colliding into each other during any movement. That is, the CAS module 1440 may be configured to receive collision data from collision-avoidance photo eyes 1150 mounted to a creel row 1111 or platform 1110, described above. The CAS module 1440 may work in concert with the position module 1438 or components thereof, to disable the drive command of the position module 1438 by generating a stop signal based on collision data from the collision-avoidance photo eyes 1150. In other words, the CAS module 1440 may receive collision data from at least one eye sensor 1150 associated with each creel row 1111 and determine a distance between a creel row 1111 in motion and adjacent creel row. When the moving creel row 1111 travels to a certain threshold distance toward an adjacent creel row 1111, the CAS module 1440 sends a stop signal to the motor 1108 driving the motion of the creel row 1111, avoiding a collision between the moving creel row and adjacent creel row.

The various components of the computer system 1416 may all be connected by a data/control bus 1425. The processor 1424 of the computer system 1416 is in communication with an associated data storage 119 via a link 1442 and is in communication with the various subsystems, e.g., APC system 118, LWD system, and environmental sensors 1460 and sensors via link 1443. A suitable communications link 1442, 1443 may include, for example, the public switched telephone network, a proprietary communications network, infrared, optical, or other suitable wired or wireless data communications.

Therefore, the disclosed systems and methods are well adapted to attain the ends and advantages mentioned as well as those that are inherent therein. The particular embodiments disclosed above are illustrative only, as the teachings of the present disclosure may be modified and practiced in different but equivalent manners apparent to those skilled in the art having the benefit of the teachings herein. Furthermore, no limitations are intended to the details of construction or design herein shown, other than as described in the claims below. It is, therefore, evident that the particular illustrative embodiments disclosed above may be altered, combined, or modified and all such variations are considered within the scope of the present disclosure. The systems and methods illustratively disclosed herein may suitably be practiced in the absence of any element that is not specifically disclosed herein and/or any optional element disclosed herein. While compositions and methods are described in terms of "comprising," "containing," or "including" various components or steps, the compositions and methods can also "consist essentially of" or "consist of" the various components and steps. All numbers and ranges disclosed above may vary by some amount. Whenever a numerical range with a lower limit and an upper limit is disclosed, any number and any included range falling within the range is specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values. Also, the terms in the claims have their plain, ordinary meaning unless otherwise explicitly and clearly defined by the patentee. Moreover, the indefinite articles "a" or "an," as used in the claims, are defined herein to mean one or more than one of the elements that it introduces. If there is any conflict in the usages of a word or term in this specification and one or more patent or other documents that may be incorporated herein by reference, the definitions that are consistent with this specification should be adopted.

Directional terms such as above, below, upper, lower, upward, downward, left, right, and the like are used in relation to the illustrative embodiments as they are depicted in the figures, the upward or upper direction being toward the top of the corresponding figure and the downward or lower direction being toward the bottom of the corresponding figure.

As used herein, the phrase "at least one of" preceding a series of items, with the terms "and" or "or" to separate any of the items, modifies the list as a whole, rather than each member of the list (i.e., each item). The phrase "at least one of" allows a meaning that includes at least one of any one of the items, and/or at least one of any combination of the items, and/or at least one of each of the items. By way of example, the phrases "at least one of A, B, and C" or "at least one of A, B, or C" each refer to only A, only B, or only C; any combination of A, B, and C; and/or at least one of each of A, B, and C.

To aid the Patent Office and any readers of this application and any resulting patent in interpreting the claims appended hereto, applicants do not intend any of the appended claims or claim elements to invoke 35 U.S.C. 112(f) unless the words "means for" or "step for" are explicitly used in the particular claim.

What is claimed is:

1. A creel system, comprising:

a frame having a plurality of tension controller apparatuses for paying out a wire under tension, each of the tension controller apparatuses having a brake shoe that is engageable with a spindle and a control arm that that is rotatable towards the spindle to move the brake shoe away from the spindle and rotatable away from the spindle to move the brake shoe towards the spindle;

an air pressure control system operatively connected to each of the tension controller apparatuses and actuatable to move the brake shoe towards the spindle, the tension control apparatus in communication with at least one apparatus sensor disposed on at least one of the control arms;

a central control system in communication with the air pressure control system, wherein the central control system ascertains a wire tension based on data from the apparatus sensor and the air pressure control system, and wherein the central control system is configured to actuate the air pressure control system in response to the wire tension; and a platform on which the frame is mounted, wherein the platform includes a set of wheels that are driven by a motor, and wherein the motor is in communication with the central control system which directs the motor to drive the platform to a target position.

2. The creel system according to claim 1, further comprising a loose wire detection system in communication with the central control system, the loose wire detection system comprising a wire tree positioned downstream from the frame and including a plurality of vertically spaced sensor bars configured to generate a loose wire detection signal upon contact between a wire and at least one sensor bar.

3. The creel system according to claim 1, further comprising a tension monitoring system in communication with the central control system, the tension monitoring system comprising a tension monitoring stand positioned downstream from the frame, the tension monitoring stand including at least one tension sensor that receives a wire from the frame, wherein the at least one tension sensor measures the tension of the received wire and generates a tension output signal that is sent to the central control system, wherein the central control system changes the air pressure of the air pressure control system based on the tension output signal.

4. The creel system according to claim 3, the tension monitoring stand comprising a left tension sensor, a center tension sensor, and a right tension sensor, each configured to receive a wire from a left portion of a plane of wires, a wire from a central portion of the plane of wires, and a wire from a right portion of the plane of wires.

5. The creel system according to claim 1, wherein the platform includes a proximity sensor configured to generate a position signal in response to reading at least one feature plate located at a predetermined position on a creel room floor.

6. The creel system according to claim 5, wherein the feature plate comprises a plate body having a plurality of pockets, each pocket is configured to receive one of a steel and nylon pad, an order of steel and nylon pads creating a unique code read by the proximity sensor relating to the position of the platform within a creel room.

7. The creel system according to claim 1, wherein the platform includes at least one photo eye sensor configured to measure a distance between adjacent platforms, wherein the central control system generates a stop motion signal based on a predetermined threshold distance measured by the at least one photo eye sensor.

8. The creel system according to claim 1, further comprising at least one mechanical travel limit switch in communication with the central control system configured to prevent over-travel of the platform beyond a predetermined location.

9. The creel system according to claim 1, further comprising at least one pull switch comprising a rope mounted at a front end of a creel row, the pull switch generates a stop signal when the rope is pulled, the stop signal readable by the central control system to cease operation of the creel system.

10. The creel system according to claim 9, wherein the central control system is configured to shut down the creel system based on the stop signal generated from the creel row based on a determined position of the creel row in a creel room.

11. The creel system according to claim 1, further comprising a data storage in communication with the central control system, the data storage configured to storage a log file.

* * * * *